US010128628B2

(12) United States Patent
Ootsuka et al.

(10) Patent No.: US 10,128,628 B2
(45) Date of Patent: Nov. 13, 2018

(54) WIRE WITH TERMINAL AND MANUFACTURING METHOD THEREFOR

(71) Applicants: AutoNetworks Technologies, Ltd., Yokkaichi, Mie (JP); Sumitomo Wiring Systems, Ltd., Yokkaichi, Mie (JP); Sumitomo Electric Industries, Ltd., Osaka-shi, Osaka (JP); TOYOTA JIDOSHA KABUSHIKI KAISHA, Toyota, Aichi (JP)

(72) Inventors: Takuji Ootsuka, Mie (JP); Hiroki Hirai, Mie (JP); Junichi Ono, Mie (JP); Kenji Miyamoto, Mie (JP); Toshiya Oota, Mie (JP); Takahito Nakashima, Aichi (JP); Hiroshi Kobayashi, Aichi (JP)

(73) Assignees: AutoNetworks Technologies, Ltd., Yokkaichi, Mie (JP); Sumitomo Wiring Systems, Ltd., Yokkaichi, Mie (JP); Sumitomo Electric Industries, Ltd., Osaka-shi, Osaka (JP); Toyota Jidosha Kabushiki Kaisha, Toyota-shi, Aichi (JP)

( * ) Notice: Subject to any disclaimer, the term of this patent is extended or adjusted under 35 U.S.C. 154(b) by 0 days.

(21) Appl. No.: 15/533,858

(22) PCT Filed: Dec. 3, 2015

(86) PCT No.: PCT/JP2015/084008
§ 371 (c)(1),
(2) Date: Jun. 7, 2017

(87) PCT Pub. No.: WO2016/098606
PCT Pub. Date: Jun. 23, 2016

(65) Prior Publication Data

US 2017/0331243 A1 Nov. 16, 2017

(30) Foreign Application Priority Data

Dec. 15, 2014 (JP) ..... 2014-253135

(51) Int. Cl.
*H01R 4/00* (2006.01)
*H01R 43/02* (2006.01)
(Continued)

(52) U.S. Cl.
CPC ..... *H01R 43/0207* (2013.01); *H01R 4/18* (2013.01); *H01R 4/185* (2013.01); *H01R 4/62* (2013.01);
(Continued)

(58) Field of Classification Search
CPC ..... H01R 43/0207; H01R 4/18; H01R 4/625; H01R 43/048; H01R 43/05
(Continued)

(56) References Cited

U.S. PATENT DOCUMENTS 2,789,277 A * 4/1957 Schumacher ..... H01R 4/184 439/877
8,628,363 B2 * 1/2014 Kobayashi ..... H01R 4/185 439/877
(Continued)

FOREIGN PATENT DOCUMENTS

CN 102089940 A 6/2011
JP 2004071372 A 3/2004
(Continued)

OTHER PUBLICATIONS

International Search Report for Application No. PCT/JP2015/084008 dated Feb. 2, 2016, 5 pages.
(Continued)

*Primary Examiner* — William H Mayo, III
(74) *Attorney, Agent, or Firm* — Reising Ethington, P.C.

(57) ABSTRACT

A method for manufacturing a terminal-attached electric wire including an electric wire including a core wire having
(Continued)

plurality of strand wires, and a female terminal including wire barrels crimped around the core wire. The method includes a first step of applying ultrasonic vibrations to the core wire, and a second step of crimping the wire barrels in a region of the core wire to which ultrasonic vibrations have been applied. The first step includes applying ultrasonic vibrations to the core wire while leaving a compression margin for the crimping by the second step such that the resistance between the electric wire and the female terminal is stabilized until the strand wires of the terminal-attached electric wire are severed when the core wire of the terminal-attached electric wire is further compressed after the second step.

4 Claims, 21 Drawing Sheets

(51) Int. Cl.

| | |
|---|---|
| ***H01R 4/18*** | (2006.01) |
| ***H01R 4/62*** | (2006.01) |
| ***H01R 43/048*** | (2006.01) |
| ***H01R 11/11*** | (2006.01) |
| ***H01R 43/05*** | (2006.01) |
| ***H01R 43/28*** | (2006.01) |

(52) U.S. Cl.
CPC ..... *H01R 4/625* (2013.01); *H01R 11/11* (2013.01); *H01R 43/048* (2013.01); *H01R 43/05* (2013.01); *H01R 43/28* (2013.01)

(58) Field of Classification Search
USPC ..... 174/74 R, 84 R, 84 C
See application file for complete search history.

(56) References Cited

U.S. PATENT DOCUMENTS

| | | | | |
|---|---|---|---|---|
| 8,826,533 | B2 * | 9/2014 | Seifert | H01R 4/187 228/110.1 |
| 2002/0162683 | A1 * | 11/2002 | Fujiwara | H01R 4/183 174/74 R |
| 2004/0029454 | A1 | 2/2004 | Onuma | |
| 2011/0003518 | A1 * | 1/2011 | Ono | H01R 4/185 439/877 |
| 2011/0009014 | A1 * | 1/2011 | Ono | H01R 4/185 439/877 |
| 2011/0094797 | A1 * | 4/2011 | Otsuka | H01R 43/0207 174/84 C |
| 2012/0028494 | A1 * | 2/2012 | Ono | H01R 4/185 439/442 |
| 2012/0324727 | A1 * | 12/2012 | Seifert | H01R 4/187 29/867 |

FOREIGN PATENT DOCUMENTS

| | | | | | |
|---|---|---|---|---|---|
| JP | 2005222489 | A | | 8/2005 | |
| JP | 2005222849 | A | | 8/2005 | |
| JP | 2005319497 | A | | 11/2005 | |
| JP | 2007250393 | A | | 9/2007 | |
| JP | 2009-231079 | A | * | 10/2009 | H01R 4/00 |
| JP | 2009231079 | A | | 10/2009 | |
| JP | 2011082127 | A | | 4/2011 | |

OTHER PUBLICATIONS

Notification of Reasons for Refusal Office Action for Application No. 2014-253135 dated Aug. 30, 2016, 8 pages.
Notification of Reasons for Refusal Office Action for Application No. 2014-253135 dated Mar. 9, 2017, 2 pages.
Chinese Office Action for Application No. 201580067569.2 dated Sep. 3, 2018, 8 pages.
English Translation of Chinese Office Action for Application No. 201580067569.2 dated Sep. 3, 2018, 11 pages.

* cited by examiner

*Figure 6*
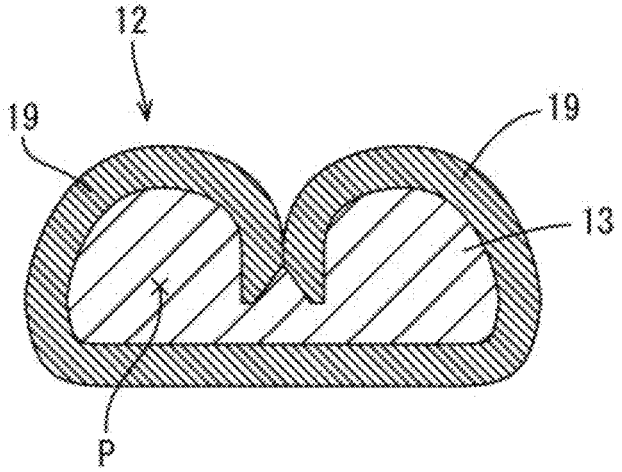
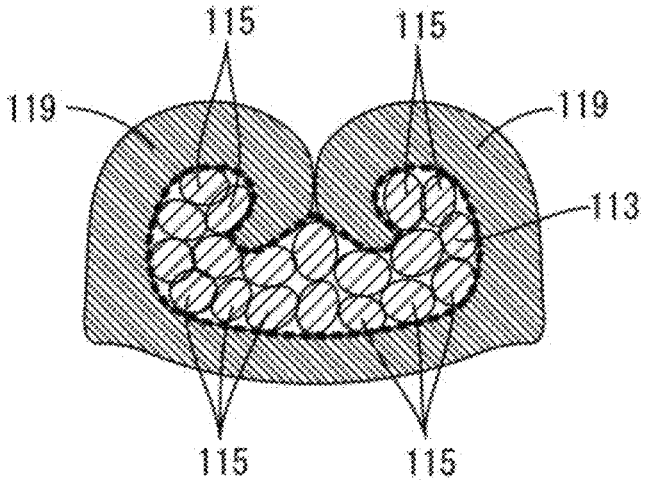
*Figure 7*

WIRE WITH TERMINAL AND MANUFACTURING METHOD THEREFOR

CROSS REFERENCE TO RELATED APPLICATIONS

This application claims the priority of Japanese patent application JP2014-253135 filed on Dec. 15, 2014, the entire contents of which are incorporated herein.

TECHNICAL FIELD

The present invention relates to a terminal-attached electric wire, and a method for manufacturing a terminal-attached electric wire.

BACKGROUND ART

Conventionally, as a terminal-attached electric wire, the electric wire described in Patent Document 1 (JP2011-82127) is known, for example. The electric wire includes an electric wire including a core wire having a plurality of strand wires, with a terminal crimped onto the core wire exposed from the electric wire. The terminal includes a crimp portion which is crimped so as to wrap around the outside of the core wire. Since the crimp portion is crimped so as to wrap around the outside of the core wire, the electric wire and the terminal are electrically connected. In the manufacturing of the terminal-attached electric wire, prior to crimping the terminal onto the core wire, ultrasonic vibrations are applied to the core wire in order to roughen the surfaces of the strand wires constituting the core wire. When the strand wires with the roughened surfaces are rubbed against each other during the crimping of the terminal, fresh surfaces of the strand wires are exposed, facilitating establishment of electrical connection between the strand wires. As a result, it becomes easier to reduce electrical resistance between the electric wire and the terminal.

However, it has been discovered that, even when ultrasonic vibrations are applied to the core wire prior to crimping the terminal onto the core wire, as in Patent Document 1, the electrical resistance between the electric wire and the terminal may not be sufficiently decreased.

In this case, while the electrical resistance can be decreased by compressing the core wire more during the crimping, excessive compression of the core wire may cause severing of the strand wires constituting the core wire.

Therefore, there is a need in the art to provide a terminal-attached electric wire in which the electrical resistance between the electric wire and the terminal is decreased, and a method for manufacturing a terminal-attached electric wire.

SUMMARY

The technology disclosed in the present description provides a method for manufacturing a terminal-attached electric wire that includes an electric wire including a core wire having a plurality of strand wires, and a terminal including a crimp portion crimped around the core wire. The method includes a first step of applying ultrasonic vibrations to the core wire; and a second step of crimping the crimp portion in a region of the core wire to which the ultrasonic vibrations have been applied. The first step includes applying ultrasonic vibrations to the core wire while leaving a compression margin for the crimping in the second step such that resistance between the electric wire and the terminal is stabilized until the strand wires of the terminal-attached electric wire are severed when the core wire of the terminal-attached electric wire is further compressed after the second step.

By initially applying ultrasonic vibrations to the core wire in the first step, the surfaces of the plurality of strand wires constituting the core wire are roughened.

Then, in the second step, the core wire is compressed by the crimp portion, whereby the plurality of strand wires are rubbed against each other. As a result, the strand wires with the roughened surfaces are rubbed against each other, whereby an oxide film formed on the surfaces of the strand wires is shaved, exposing fresh surfaces (metal surface) of the strand wires. The fresh surfaces of the thus exposed strand wires are contacted with each other, whereby the plurality of strand wires are electrically connected.

When the core wire is compressed by the crimp portion, the oxide film formed on the surfaces of the strand wires is shaved, fresh surfaces of the strand wires are exposed, and the fresh surfaces of the exposed strand wires and the crimp portion are electrically connected. In this way, the electrical resistance between the electric wire and the terminal can be decreased.

In addition, according to the technology disclosed in the present description, in the first step, ultrasonic vibrations are applied to the core wire while leaving a crimp margin for the crimp portion in the second step. The crimp margin is defined as being such that, when the core wire of the terminal-attached electric wire is further compressed after the second step, the electrical resistance between the electric wire and the terminal is stabilized until the strand wires of the terminal-attached electric wire are severed. By applying ultrasonic vibrations to the core wire while leaving the crimp margin defined as described above, the oxide film on the core wire surface is removed by the crimp portion, and the electrical resistance between the strand wires can be decreased while suppressing severing of the strand wires. As a result, the electrical resistance between the strand wire electric wire and the terminal can be decreased.

As used herein, "after the second step" is defined as being after completion of the second step and after completion of the terminal-attached electric wire. The "after the second step" includes the case where the terminal-attached electric wire is placed in distribution process, and also includes the case where the terminal-attached electric wire is actually being used.

As used herein, "the resistance between the electric wire and the terminal is stabilized" includes the case where the electrical resistance between the electric wire and the terminal is substantially constant, and the case where a change in the electrical resistance is relatively small, even when the degree of crimping of the crimp portion onto the core wire in the second step is changed.

As the embodiments of the present design, the following modes may be preferable.

Preferably, a first compression ratio defined by (cross sectional area of the core wire after the first step/cross sectional area of the core wire before the first step)×100(%) may be not less than 85%. Decreasing the first compression ratio means high compression of the core wire. Increasing the first compression ratio means low compression of the core wire.

If the first compression ratio is made smaller than 85% for high compression of the core wire, the compression margin for the second step may not be ensured, and this is not preferable.

Preferably, the first compression ratio may be not more than 95%.

If the first compression ratio is made greater than 95% for low compression of the core wire, the surfaces of the strand wires may not be sufficiently roughened, and the electrical resistance between the plurality of strand wires may fail to be sufficiently decreased. As a result, of the plurality of strand wires, the strand wires positioned in the vicinity of the center in the radial direction of the core wire may fail to be involved in electrical connection with the crimp portion of the terminal. This may lead to a failure to sufficiently decrease the electrical resistance between the electric wire and the terminal, and is therefore not preferable.

Preferably, the second compression ratio defined by (cross sectional area of the core wire after the second step/cross sectional area of the core wire before the first step)×100(%) may be not less than 50%.

When the second compression ratio in the second step is not less than 50%, the crimp margin for the second step can be reliably ensured. In this way, the electrical resistance value between the electric wire and the terminal can be reliably decreased.

The second compression ratio is a final indicator of the degree of compression of the core wire in the completed terminal-attached electric wire. Accordingly, immediately before the strand wires of the terminal-attached electric wire are severed by a further compression of the core wire of the terminal-attached electric wire after the second step, the core wire is in a higher compression state than after the execution of the second step. Specifically, when a pre-severing compression ratio immediately before the strand wires are severed is defined by (cross sectional area of the core wire immediately before the strand wires are severed/cross sectional area of the core wire before the first step)×100(%), there is the following relationship: second compression ratio>pre-severing compression ratio.

Preferably, the strand wire may be made of aluminum or an aluminum alloy.

When the core wire is made of aluminum or an aluminum alloy, an insulating coating such as an oxide film tends to be relatively easily formed on the surface of the core wire. The present embodiment is effective when the insulating coating tends to be easily formed on the surface of the core wire.

Preferably, the plurality of strand wires may include 20 or more strand wires, and in the state where the crimp portion is crimped on the core wire, the 20 or more strand wires may be crimped on the crimp portion.

When the core wire includes 20 or more strand wires, in the region on the inside in the radial direction of the core wire, the strand wires may fail to be contacted with the crimp portion. Accordingly, when the number of the strand wires is 20 or more, by electrically connecting the strand wires with each other, the strand wires positioned inside in the radial direction of the core wire can be electrically connected with the crimp portion.

The technology disclosed in the present description also provides a method for manufacturing a terminal-attached electric wire that includes an electric wire including a core wire having a plurality of strand wires, and a terminal including a crimp portion crimped around the core wire. The method includes a first step of applying ultrasonic vibrations to the core wire; and a second step of crimping the crimp portion in a region of the core wire to which ultrasonic vibrations have been applied. A first compression ratio defined by (cross sectional area of the core wire after the first step/cross sectional area of the core wire before the first step)×100(%) is not less than 85% and not more than 95%.

The technology disclosed in the present description also provides a terminal-attached electric wire including an electric wire including a core wire having a plurality of strand wires, and a terminal including a crimp portion crimped around the core wire. A resistance between the electric wire and the terminal is stable until the strand wire is severed when the core wire of the terminal-attached electric wire is compressed.

The technology disclosed in the present description provides a terminal-attached electric wire including an electric wire including a core wire having a plurality of strand wires, and a terminal including a crimp portion crimped around the core wire. The terminal-attached electric wire is manufactured by executing a first step of applying ultrasonic vibrations to the core wire, and a second step of crimping the crimp portion in a region of the core wire to which ultrasonic vibrations have been applied. The first step includes applying ultrasonic vibrations to the core wire while leaving a compression margin for the crimping in the second step such that resistance between the electric wire and the terminal is stabilized until the strand wires of the terminal-attached electric wire are severed when the core wire of the terminal-attached electric wire is compressed.

The technology disclosed in the present description may provide a terminal-attached electric wire including an electric wire in which a core wire having a plurality of strand wires is coated with an insulation coating, and a terminal including a crimp portion which is crimped on the core wire exposed from the insulation coating. The core wire exposed from the insulation coating includes a primary compressed region compressed by application of ultrasonic vibrations, a secondary compressed region which is further compressed by crimping the crimp portion of the terminal in a region including the primary compressed region, and a non-compressed region which is disposed at a position between the secondary compressed region and the insulation coating, the position being different from the primary compressed region, the non-compressed region not being crimped by the crimp portion. Preferably, in the primary compressed region, a first compression ratio defined by (cross sectional area of the core wire in the primary compressed region/cross sectional area of the core wire in the non-compressed region)×100(%) may be between 85(%) and 95% inclusive, and in the secondary compressed region, a second compression ratio defined by (cross sectional area of the core wire in the secondary compressed region/cross sectional area of the core wire in the non-compressed region)×100(%) may be between 50(%) and 80% inclusive.

If the first compression ratio is less than 85%, when the crimp portion is crimped on the core wire to a degree to which electric performance is ensured, sufficient mechanical strength may not be ensured. This may result in a severing of the terminal-attached electric wire, and is not preferable. If the first compression ratio exceeds 95%, the strand wires are not electrically sufficiently contacted with each other. This may lead to the problem of a failure to sufficiently suppress an increase in electrical resistance after the terminal is crimped, and is therefore not preferable. According to the present technology, by setting the first compression ratio between 85% and 95% inclusive, the plurality of strand wires can be electrically connected.

In addition, according to the present technology, in the state where the first compression ratio is set between 85% and 95% inclusive, so that the strand wires are electrically connected, the crimp portion is crimped on the core wire with the second compression ratio set lower than the first compression ratio. Thus, the core wire is reliably compressed by the crimp portion, whereby the electrical connection between the crimp portion and the core wire can be ensured.

Thus, according to the present technology, a plurality of strand wires are electrically connected, and the core wire having the plurality of strand wires and the crimp portion can be reliably electrically connected. As a result, the electrical resistance between the electric wire and the terminal can be decreased.

According to the present design, the electrical resistance between the electric wire and the terminal can be decreased.

BRIEF DESCRIPTION OF THE DRAWINGS

FIG. 6 is a cross sectional view taken along line VI-VI of FIG. 1;

FIG. 7 is a cross sectional view illustrating a state in which a core wire including 19 strand wires is crimped on wire barrels;

DESCRIPTION

First Embodiment

A first embodiment of the present design will be described with reference to FIG. 1 to FIG. 19. A terminal-attached electric wire 10 according to the present embodiment includes an electric wire 11, and a female terminal 12 (an example of a terminal) connected to the end of the electric wire 11. In the following description, "top" corresponds to the top in FIG. 1, and "bottom" corresponds to the bottom in the figure. "Forward" corresponds to the left in FIG. 1, and "rearward" corresponds to the right in the figure. In the following description, with respect to a plurality of members having the same shape, only one of the members may be designated with a reference sign, and the reference sign may be omitted for the other members.

Figure 1:
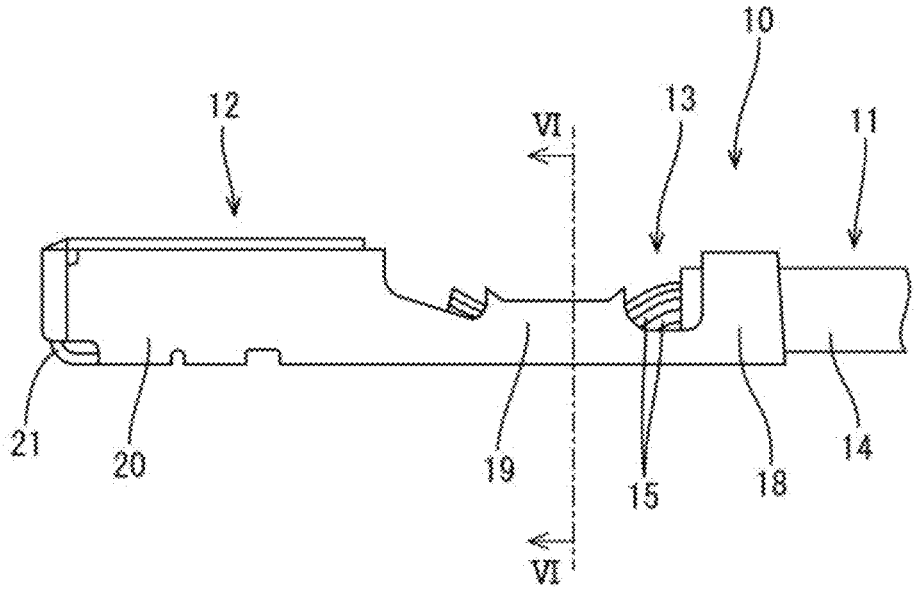
FIG. 1 is a side view of a terminal-attached electric wire according to a first embodiment.

As illustrated in FIG. 1, the electric wire 11 is disposed extending in a front-rear direction in a state of being connected to the female terminal 12. As illustrated in FIG. 1, the electric wire 11 includes a core wire 13 of which an outer periphery is surrounded by an insulation coating 14. For the core wire 13, any metal may be used as needed, such as aluminum, an aluminum alloy, copper, or a copper alloy. In the present embodiment, aluminum or an aluminum alloy is used.

The core wire 13 includes a twisted wire obtained by twisting a number of strand wires 15. From the end of the electric wire 11, the insulation coating 14 is peeled by a predetermined length, exposing the core wire 13 from the tip-end portion of the insulation coating 14. The core wire 13 according to the present embodiment includes 20 or more strand wires 15. The number of the strand wires 15 may be determined by a standard such as JIS (for example, 37), or the core wire 13 may include a number of strand wires 15 not in accordance with a standard.

Figure 4:
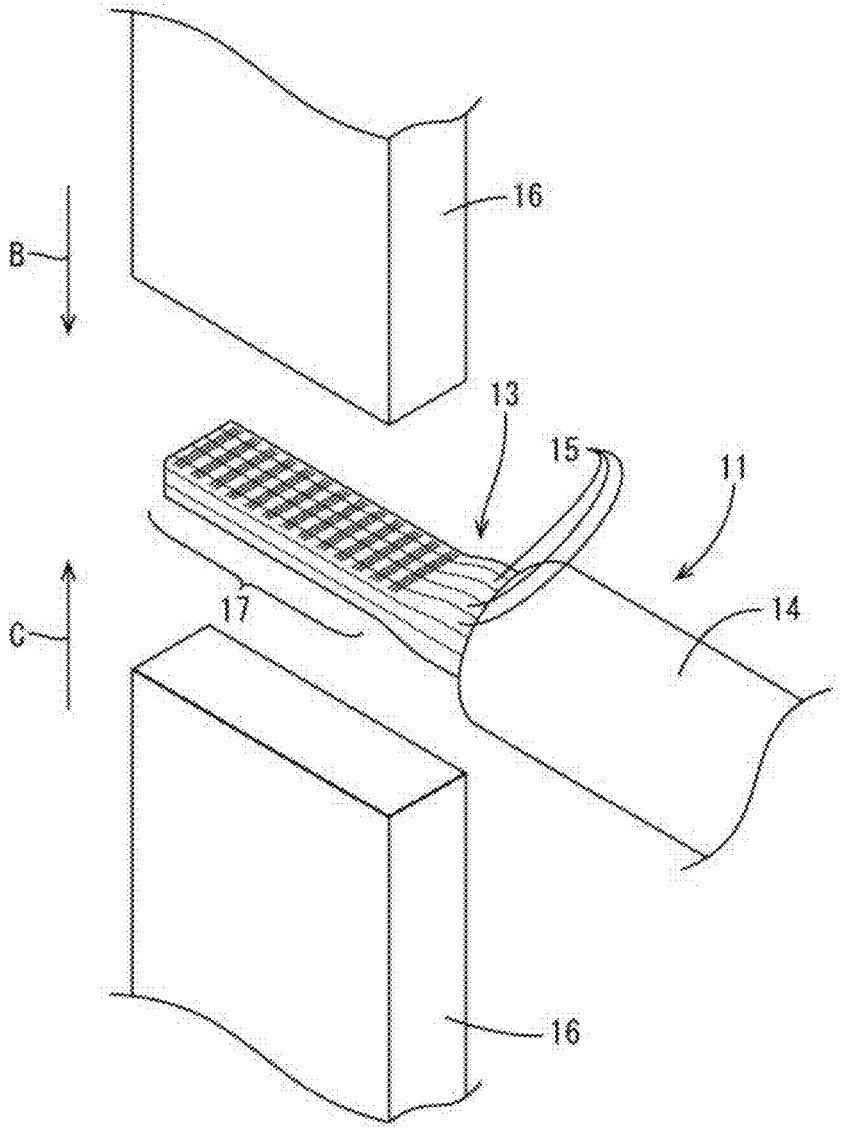
FIG. 4 is a perspective view illustrating a state after application of ultrasonic vibrations to the core wire.

As illustrated in FIG. 4, in the present embodiment, a plurality of strand wires 15 constituting the core wire 13 exposed from the electric wire 11 are sandwiched by a pair of jigs 16, 16 in a top-bottom direction, for the application of ultrasonic vibrations. Specifically, the core wire 13 is sandwiched directly from above by an upper jig 16 (in a direction indicated by arrow B), and from below by a lower jig 16 (in a direction indicated by arrow C). When ultrasonic vibrations are applied from the jigs 16, the strand wires 15 are rubbed against each other, whereby their surfaces are roughened and a roughened region 17 is formed. The roughened region 17 is formed on the surface of each of the strand wires 15 positioned in the region in which the strand wires 15 are roughened against each other. The plurality of strand wires 15 may be welded to each other as a result of the application of ultrasonic vibrations.

The female terminal 12 is formed by press-forming a metal sheet material, not illustrated, into a predetermined shape. For the female terminal 12, any metal may be selected as needed, such as copper, a copper alloy, aluminum, an aluminum alloy, iron, or an iron alloy. In the present embodiment, copper or a copper alloy is used.

On the surface of the female terminal 12, a plating layer, not illustrated, is formed. For the plating layer, any metal may be selected as needed, such as tin or nickel. In the present embodiment, a tin plating layer is formed.

The female terminal 12 has formed therein a pair of insulation barrels 18 which are crimped so as to wrap around the insulation coating 14 of the electric wire 11 from the outside. At a position on the left of the insulation barrels 18 in FIG. 1, wire barrels 19 (an example of a crimp portion) are formed continuously with the insulation barrels 18, the wire barrels 19 being crimped so as to wrap around the core wire 13 of the electric wire 11 from the outside.

As illustrated in FIG. 1, at a position forwardly of the wire barrels 19 (on the left in FIG. 1), a connection portion 20 is formed continuously with the wire barrels 19, which connection portion 20 is to be mated and electrically connected with a counterpart terminal, not illustrated. In the present embodiment, the counterpart terminal is a male terminal. The connection portion 20 has the shape of a tube into which the male terminal can be inserted. The connection portion 20 has formed therein an elastic contact piece 21. When the elastic contact piece 21 and the male terminal elastically contact each other, the male terminal and the female terminal 12 are electrically connected.

Figure 2:
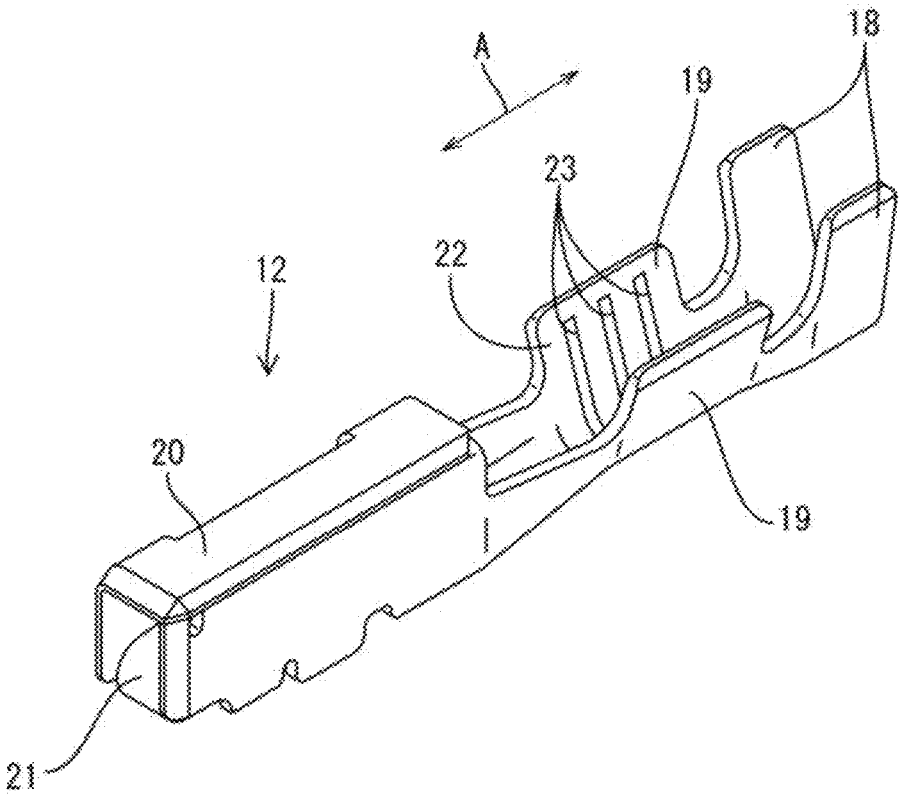
FIG. 2 is a perspective view of a terminal.

As illustrated in FIG. 2, recess portions 23 are formed in a contact surface 22 of the wire barrels 19 of the female terminal 12 so as to contact the core wire 13. In the present embodiment, three recess portions 23 are formed side by side at intervals in a direction in which the electric wire 11 extends (in FIG. 2, the direction indicated by arrow A).

As illustrated in FIG. 1, the wire barrels 19 are crimped so as to wrap around the outer periphery of the core wire 13 exposed from the electric wire 11. In the present embodiment, the roughened region 17 is formed in a region slightly wider in the front-rear direction than the length of the wire barrels 19 in the front-rear direction.

As illustrated in FIG. 6, when the wire barrels 19 are crimped so as to wrap around the core wire 13, pressure is applied to the core wire 13 from wire barrel 19 pieces. As a result, the insulating coating, such as an oxide film, formed on the surface of the core wire 13 is broken, exposing a fresh surface (metal surface) of the core wire 13. When the fresh surface and the contact surface 22 of the wire barrels 19 contact each other, the electric wire 11 and the female terminal 12 are electrically connected. In FIG. 6, the shape of the strand wires 15 is omitted.

In the present embodiment, ultrasonic vibrations are applied to the core wire 13 in a first step, and the wire barrels 19 are crimped around the core wire 13 in a second step. In the first step, ultrasonic vibrations are applied to the core wire 13 while leaving a crimp margin for the wire barrels 19 in the second step. The crimp margin is defined as being adapted to stabilize the electrical resistance between the electric wire 11 and the female terminal 12 before the strand wires 15 of the terminal-attached electric wire 10 are severed in a case where, after the second step, the core wire 13 of the terminal-attached electric wire 10 is further compressed.

As used herein, "after the second step" is defined as being after completion of the second step and after completion of the terminal-attached electric wire 10. The "after the second step" includes the case where the terminal-attached electric wire 10 is placed in distribution process, and also includes the case where the terminal-attached electric wire 10 is actually being used.

As used herein, "the resistance between the electric wire 11 and the female terminal 12 is stabilized" includes the case where the electrical resistance between the electric wire 11 and the female terminal 12 is substantially constant, and the case where the change in the electrical resistance is relatively small, even if the degree to which the wire barrels 19 are crimped onto the core wire 13 in the second step is changed.

In the present embodiment, in the first step of applying ultrasonic vibrations to the core wire 13, a first compression ratio defined by (cross sectional area of the core wire after the first step/cross sectional area of the core wire before the first step)×100(%) is set between 85% and 95%, inclusive. That the first compression ratio is high means low compression, and that the first compression ratio is low means high compression.

The cross sectional area of the core wire before execution of the first step was measured by observing a cut cross section.

The cross sectional area of the core wire after execution of the first step was measured by observing a cut cross section.

In the present embodiment, in the second step of crimping the wire barrels 19 onto the core wire 13, a second compression ratio defined by (cross sectional area of the core wire after the second step/cross sectional area of the core wire before the first step)×100(%) is preferably set between 50% and 80% inclusive, and more preferably between 60% and 70% inclusive. That the second compression ratio is high means low compression, and that the second compression ratio is low means high compression.

The cross sectional area of the core wire after execution of the second step was measured by observing a cut cross section.

An example of a method for manufacturing the terminal-attached electric wire 10 will now be described. First, a metal sheet material is pressed into a predetermined shape. In this case, the recess portions 23 may be simultaneously formed.

Thereafter, the metal sheet material formed in the predetermined shape is bent to form the connection portion 20 (see FIG. 2). In this case, the recess portions 23 may be formed.

Figure 3:
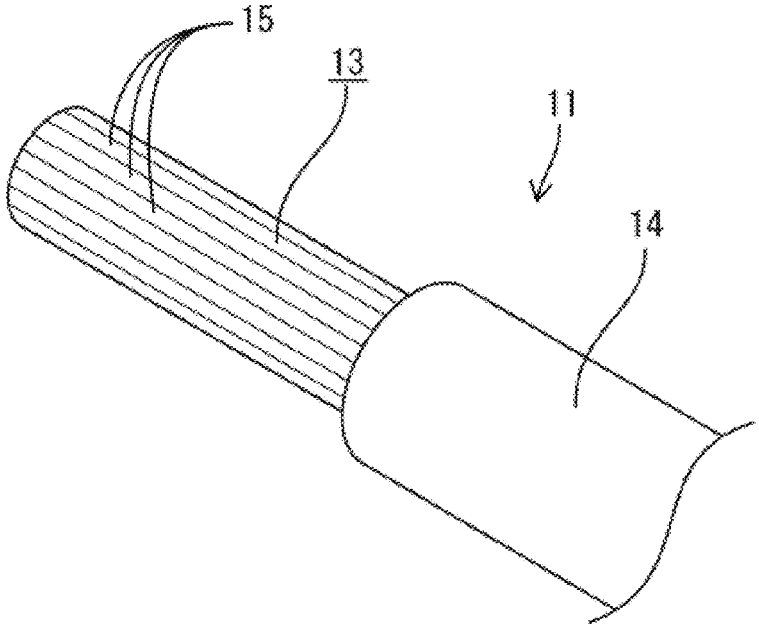
FIG. 3 is a perspective view of a core wire exposed from an end portion of an electric wire.

Then, the insulation coating 14 is peeled at the end of the electric wire 11 to expose the core wire 13 (see FIG. 3).

As illustrated in FIG. 4, the exposed core wire 13 is then pinched by a pair of jigs 16, 16. In the present embodiment, the pair of jigs 16, 16 are adapted to directly pinch the core wire 13 in the top-bottom direction in FIG. 4. After the core wire 13 is pinched by the jigs 16, ultrasonic vibrations are applied to the core wire 13 via the jigs 16 (an example of the first step). As ultrasonic vibration conditions, known conditions may be used.

The application of ultrasonic vibrations to the core wire 13 causes the plurality of strand wires 15 constituting the core wire 13 to rub against each other. Consequently, the surfaces of the strand wires 15 are roughened, forming the roughened region 17. Thereafter, ultrasonic vibrations are stopped, the pair of jigs 16, 16 are moved apart from each other, and the core wire 13 is removed from the jigs 16 and cooled (releases heat).

After the roughened region 17 is formed, if ultrasonic vibrations are further applied to the core wire 13, the surfaces of the strand wires 15 can be melted by heat of friction. In this case, the core wire 13 releases heat, so that the strand wires 15 are welded to each other.

As illustrated in FIG. 4, after the application of ultrasonic vibrations, the core wire 13 is formed into a flat shape with respect to the direction in which the core wire 13 is pinched by the pair of jigs 16, 16 (the top-bottom direction in FIG. 4).

Figure 5:
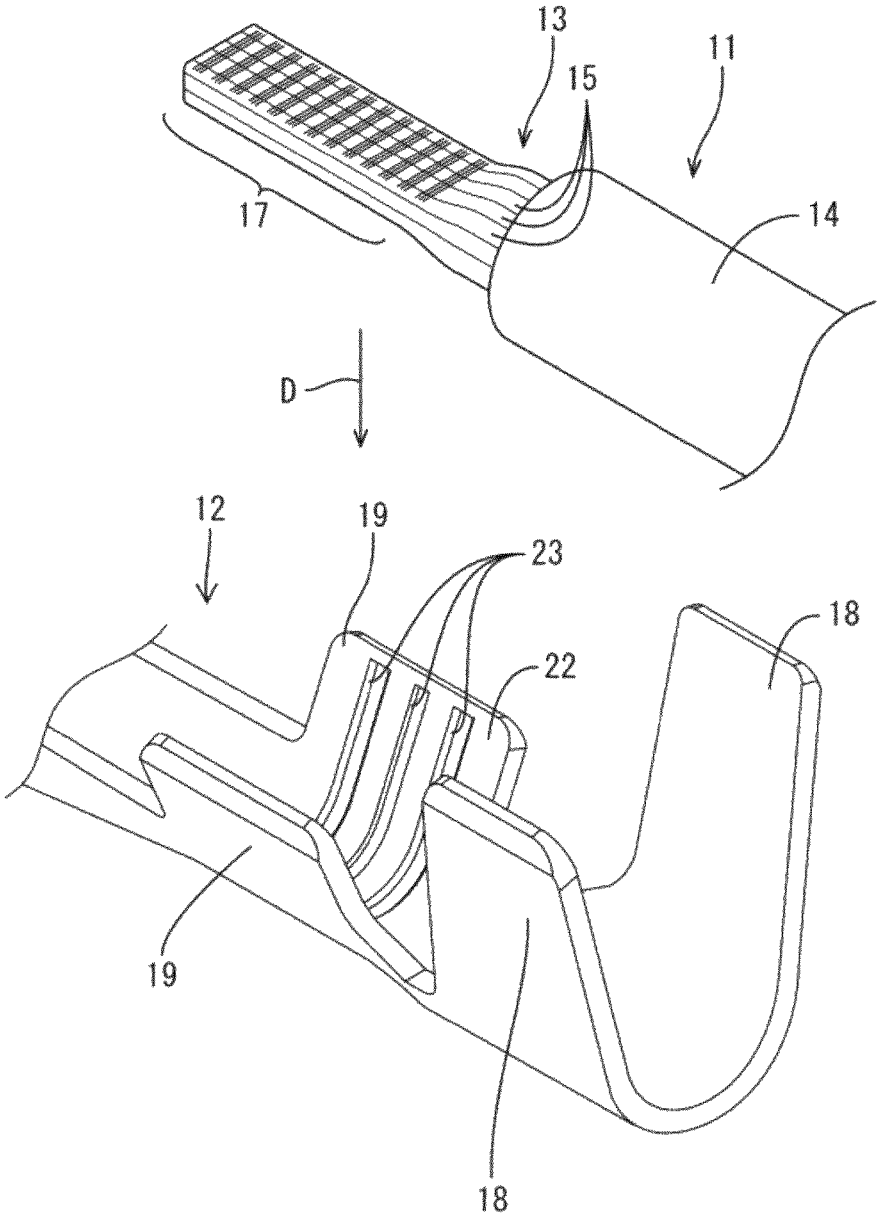
FIG. 5 is a perspective view illustrating a state prior to mounting, on wire barrels, the core wire to which ultrasonic vibrations have been applied.

As illustrated in FIG. 5, after the application of ultrasonic vibrations to the core wire 13, the portion of the core wire 13 that includes the roughened region 17 is placed on the wire barrels 19. With the insulation coating 14 placed on the insulation barrels 18, the electric wire 11 is sandwiched by a pair of molds, not illustrated, in the top-bottom direction. The wire barrels 19 are then crimped so as to embrace the electric wire 11 from the outside (an example of the second step). In the present embodiment, the core wire 13 formed in flat shape is sandwiched by the pair of molds for crimping the wire barrels 19 in a direction intersecting the flat surface of the core wire 13. By executing the above steps, the terminal-attached electric wire 10 is completed.

The operation and effect of the present embodiment will now be described. According to the present embodiment, ultrasonic vibrations are applied to the core wire 13, whereby the strand wires 15 constituting the core wire 13 are rubbed against each other. Since the surfaces of the strand wires 15 are rubbed against each other, the surfaces of the strand wires 15 are roughened, forming the roughened region 17.

When the wire barrels 19 are crimped on the core wire 13 including the strand wires 15 having the roughened region 17 formed thereon, the wire barrels 19 apply a force that causes the strand wires 15 to rub against each other. Since the roughened regions 17 formed on the surfaces of the strand wires 15 are rubbed against each other, the coating, such as an oxide film, formed on the surfaces of the strand wires 15 is peeled, thereby exposing the fresh surfaces of the strand wires 15. Since the exposed fresh surfaces are contacted with each other, the strand wires 15 are electrically connected with each other. Thus, the strand wires 15 positioned on the inside in the radial direction of the core wire 13 can contribute to the electrical connection between the electric wire 11 and the female terminal 12. Accordingly, the electrical resistance between the electric wire 11 and the female terminal 12 can be decreased.

In addition, the contacted fresh surfaces adhere to each other and form an alloy, so that new formation of an insulating coating, such as an oxide film, on the fresh surface of the strand wires 15 is suppressed. In this way, the electrical resistance between the electric wire 11 and the female terminal 12 can be maintained in a decreased state.

The strand wires 15 are welded to each other, and thus electrically connected. With this configuration, when the core wire 13 is crimped, the strand wires 15 positioned on the inside in the radial direction of the core wire 13 can reliably contribute to the electrical connection between the electric wire 11 and the female terminal 12. Accordingly, the electrical resistance between the electric wire 11 and the female terminal 12 can be further decreased.

When the wire barrels 19 apply force to the core wire 13, the strand wires 15 and the wire barrels 19 are rubbed against each other. As a result, the coating, such as an oxide film, formed on the surfaces of the strand wires 15 is peeled, exposing the fresh surfaces of the strand wires 15. The exposed fresh surfaces and the wire barrels 19 contact each other, and thus the core wire 13 and the wire barrels 19 are electrically connected. In this way, the strand wires 15 positioned on the inside in the radial direction of the core wire 13 and the wire barrels 19 can be electrically connected.

As described above, in the first step, ultrasonic vibrations are applied to the core wire 13 while leaving a crimp margin for the wire barrels 19 in the second step. The crimp margin is defined as being such that, when the core wire 13 of the terminal-attached electric wire 10 is further compressed after the second step, the electrical resistance between the electric wire 11 and the female terminal 12 is stabilized until the strand wires 15 of the terminal-attached electric wire 10 are severed.

By applying ultrasonic vibrations to the core wire 13 while leaving the crimp margin defined as described above, the oxide film on the surface of the core wire 13 can be removed by the wire barrels 19, and the electrical resistance between the plurality of strand wires 15 can be decreased while suppressing severing of the strand wires 15. As a result, the electrical resistance between the electric wire 11 and the female terminal 12 can be decreased.

In the present embodiment, the first compression ratio defined by (cross sectional area of the core wire 13 after the first step/cross sectional area of the core wire 13 before the first step)×100(%) is not less than 85%. Decreasing the first compression ratio means high compression of the core wire 13. Increasing the first compression ratio means low compression of the core wire 13.

Decreasing the first compression ratio below 85% for high compression of the core wire 13 leads to a failure to ensure a compression margin in the second step and is not preferable.

In the present embodiment, the first compression ratio is not more than 95%.

If the first compression ratio is increased to more than 95% and the core wire 13 is lowly compressed, the surfaces of the strand wires 15 cannot be sufficiently roughened, resulting in a failure to sufficiently decrease the electrical resistance between the plurality of strand wires 15. As a result, of the plurality of strand wires 15, strand wires 15 positioned in the vicinity of the center in the radial direction of the core wire 13 may fail to be involved in electrical connection with the wire barrels 19 of the female terminal 12. As a result, the electrical resistance between the electric wire 11 and the female terminal 12 may fail to be sufficiently decreased, which is not preferable.

In the present embodiment, the second compression ratio defined by (cross sectional area of the core wire 13 after the second step/cross sectional area of the core wire 13 before the first step)×100(%) is not less than 50%.

When the second compression ratio in the second step is not less than 50%, the crimp margin in the second step can be reliably ensured. In this way, the electrical resistance between the electric wire 11 and the female terminal 12 can be reliably decreased.

The second compression ratio is a final indicator of the degree of compression of the core wire 13 in the completed terminal-attached electric wire 10. Accordingly, immediately before the strand wires 15 of the terminal-attached electric wire 10 are severed by an additional compression of the core wire 13 of the terminal-attached electric wire 10 after the second step, the core wire 13 is in a higher compression state than after the execution of the second step. Specifically, if a pre-severing compression ratio immediately before severing of the strand wires 15 is defined by (cross sectional area of the core wire 13 immediately before severing of the strand wires 15/cross sectional area of the core wire 13 before the first step)×100(%), there is the relationship: second compression ratio>pre-severing compression ratio.

In the present embodiment, in the first step of applying ultrasonic vibrations to the core wire 13, the first compression ratio defined by (cross sectional area of the core wire after the first step/cross sectional area of the core wire before the first step)×100(%) is preferably set between 85% and 95% inclusive, and more preferably 90%.

If the first compression ratio is greater than 95%, the energy of the ultrasonic vibrations applied to the core wire 13 in the first step is decreased. In this case, the plurality of strand wires 15 are not electrically sufficiently contacted with each other. This may lead to the problem of, e.g., a failure to sufficiently suppress an increase in electrical resistance after the female terminal 12 is crimped, and is not preferable.

When the first compression ratio is smaller than 90%, the plurality of strand wires 15 are welded to each other. This leads to a further decrease in the electrical resistance between the plurality of strand wires 15 and is more preferable.

In the present embodiment, in the second step of crimping the wire barrels 19 onto the core wire 13, the second compression ratio defined by (cross sectional area of the core wire after the second step/cross sectional area of the core wire before the first step)×100(%) is preferably set between 50% and 80% inclusive, and more preferably between 60% and 70% inclusive. That the value of the second compression ratio is large means low compression. That the value of the second compression ratio is small means high compression.

By decreasing the second compression ratio to be smaller than 80%, the core wire 13 can be highly compressed. In this way, the core wire 13 can be sufficiently compressed by the wire barrels 19, whereby the surfaces of the strand wires 15 and the wire barrels 19 can be sufficiently rubbed against each other. This makes it possible to ensure a sufficient decrease in the electrical resistance between the core wire 13 and the wire barrels 19, and is preferable.

In the present embodiment, the core wire 13 includes aluminum or an aluminum alloy. When the core wire 13 includes aluminum or an aluminum alloy, an insulating coating such as an oxide film tends to be relatively easily formed on the surface of the core wire 13. The present embodiment is effective when the insulating coating tends to be easily formed on the surface of the core wire 13.

In the wire barrels 19, the core wire 13 having 20 or more (37 in the present embodiment) strand wires 15 is crimped. In this case, the present embodiment makes it possible to electrically reliably connect the plurality of strand wires 15 positioned on the inside in the radial direction of the wire barrels 19, and is particularly effective. This point will be described schematically below.

As illustrated in FIG. 7, when there are 19 strand wires 115, each of the strand wires 115 has a portion in contact with wire barrels 119 when the wire barrels 119 are crimped on the core wire 113.

Figure 8:
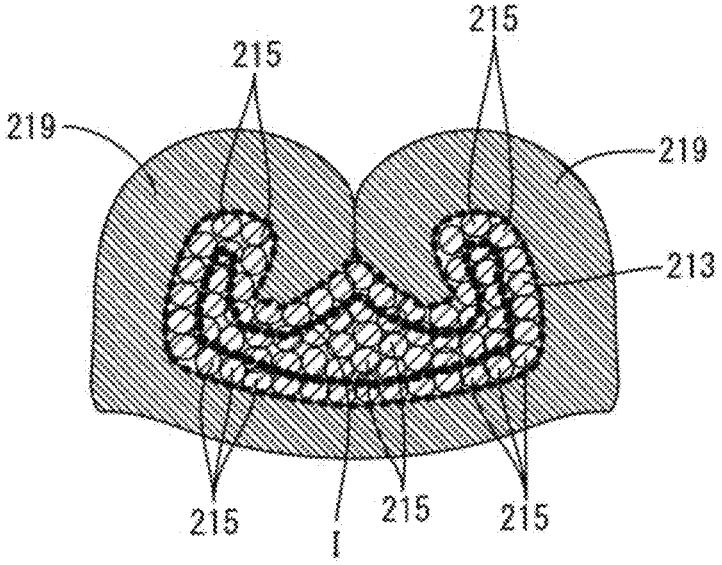
FIG. 8 is a cross sectional view illustrating a state in which a core wire including 71 strand wires is crimped on wire barrels.

In contrast, as illustrated in FIG. 8, if a core wire 213 includes 20 or more (71 in FIG. 8) strand wires 215, in a region I on the inside in the radial direction of the core wire 213, the strand wires 215 may not contact wire barrels 219. Specifically, when the core wire 213 has 20 or more, the core wire 213, as observed in cross section shape, is formed in a plurality of layers. With respect to the strand wires 215 in the outer-most layer (a first layer), the oxide film is removed by coming into contact with the inner peripheral surface of the wire barrels 219 after crimping of a terminal, thereby decreasing electrical resistance. On the other hand, with respect to the layers (a second layer and a third layer) formed on the inner side than the outer-most layer, while the strand wires 215 contact each other but the oxide film is not sufficiently removed in the absence of application of ultrasonic vibrations to the core wire 213, resulting in an increase in electrical resistance. Accordingly, when the number of the strand wires 215 is 20 or more, by electrically connecting the strand wires 215 by application of ultrasonic vibrations, the strand wires 215 positioned inside in the radial direction of the core wire 213 can be electrically connected with the wire barrels 219.

(Description of Examples)

In the following, examples of application of the present design to the terminal-attached electric wire will be described. In the following description, experimental examples 3(2) to 3(6), 4(2) to 4(5), and 5(2) to 5(5) are examples. Experimental examples 1(1) to 1(6), 2(1) to 2(6), 3(1), 4(1), 5(1), 6(1) to 6(5), and 7(1) to 7(4) are comparative examples.

Experimental Example 1(1)

First, a metal sheet material was pressed into a predetermined shape, forming a female terminal.

Then, at the end of the electric wire, the insulation coating was peeled to expose the core wire, the core wire was pinched by a pair of jigs, and ultrasonic vibrations were applied to the core wire. In this case, the first compression ratio was 99%.

The conditions in this case included a jig pressurizing force of 13 bar, a frequency of vibration of 20 kHz, and an applied energy of 10 Ws. The device used was the Minic-II device from Schunk.

The core wire was then sandwiched by a pair of molds, not illustrated, in the top-bottom direction, and the wire barrels were crimped on the core wire. In this way, a terminal-attached electric wire was fabricated, where the second compression ratio was 45%. Table 1 shows the manufacturing conditions for the terminal-attached electric wire according to experimental example 1(1).

TABLE 1

| | FIRST STEP | | | SECOND STEP | |
|---|---|---|---|---|---|
| | ENERGY (Ws) | PRESSURIZING FORCE (bar) | FIRST COMPRESSION RATIO (%) | SECOND COMPRESSION RATIO (%) | REMARKS |
| EXPERIMENTAL EXAMPLE 1(1) | 10 | 1 | 99 | 45 | COMPARATIVE EXAMPLE |
| EXPERIMENTAL EXAMPLE 1(2) | 10 | 1 | 99 | 52 | COMPARATIVE EXAMPLE |
| EXPERIMENTAL EXAMPLE 1(3) | 10 | 1 | 99 | 60 | COMPARATIVE EXAMPLE |
| EXPERIMENTAL EXAMPLE 1(4) | 10 | 1 | 99 | 70 | COMPARATIVE EXAMPLE |

TABLE 1-continued

| | FIRST STEP | | | SECOND STEP | |
|---|---|---|---|---|---|
| | ENERGY (Ws) | PRESSURIZING FORCE (bar) | FIRST COMPRESSION RATIO (%) | SECOND COMPRESSION RATIO (%) | REMARKS |
| EXPERIMENTAL EXAMPLE 1(5) | 10 | 1 | 99 | 80 | COMPARATIVE EXAMPLE |
| EXPERIMENTAL EXAMPLE 1(6) | 10 | 1 | 99 | 90 | COMPARATIVE EXAMPLE |

Figure 10:
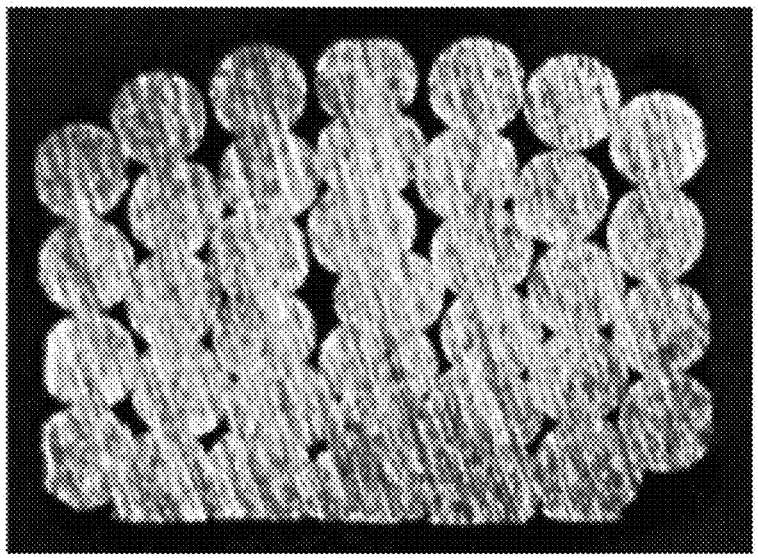
FIG. 10 is a photograph of a cross section of the core wire according to experimental example 1(1), after execution of the first step and before execution of the second step.

FIG. 10 is an enlarged photograph of a cross section of the core wire after execution of the first step and prior to execution of the second step. It can be visually confirmed that in experimental example 1(1), the shape of each strand wire was left intact.

Experimental Examples 1(2) to 1(6)

With respect to experimental examples 1(2) to 1(6), the terminal-attached electric wire was fabricated in the same way as in experimental example 1(1) with the exception that the second compression ratio in the second step had the values shown in Table 1.

Experimental Example 2(1)

With respect to experimental example 2(1), a terminal fitting was fabricated in the same way as in experimental example 1(1) with the exception that in the first step, the energy applied to the core wire was 30 Ws, and the first compression ratio was 97%. Table 2 shows the manufacturing conditions for the terminal-attached electric wire according to experimental example 1(1).

Experimental Examples 2(2) to 2(6)

With respect to experimental examples 2(2) to 2(6), the terminal-attached electric wire was fabricated in the same way as in experimental example 2(1) with the exception that the second compression ratio in the second step had the values shown in Table 2.

Experimental Example 3(1)

With respect to experimental example 3(1), a terminal fitting was fabricated in the same way as in experimental example 1(1) with the exception that in the first step, the energy applied to the core wire was 40 Ws, and the first compression ratio was 95%. Table 3 shows the manufacturing conditions for the terminal-attached electric wire according to experimental example 3(1).

Figure 13:
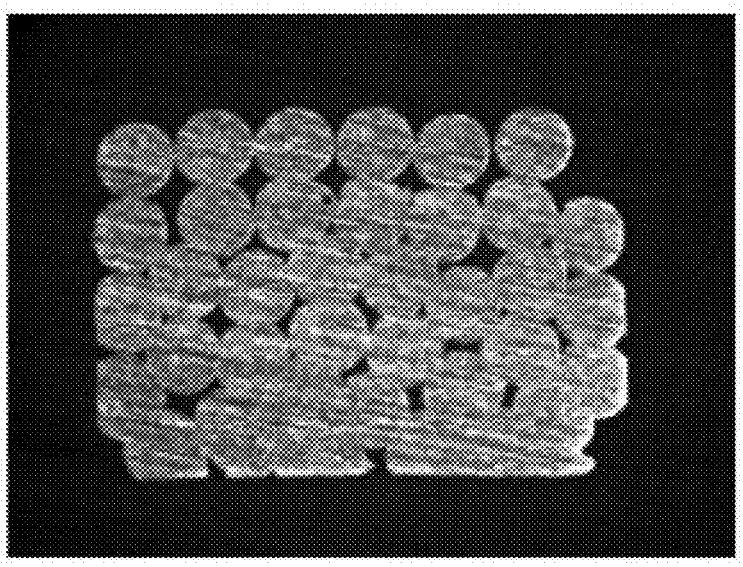
FIG. 13 is a photograph of a cross section of the core wire according to experimental example 3(1) after execution of the first step and before execution of the second step.

FIG. 13 is an enlarged photograph of a cross section of the core wire after execution of the first step and prior to execution of the second step. In experimental example 3(1), it can be visually confirmed that, while there were some strand wires with their shapes left intact, there were also some strand wires that had been bonded to each other and become integrated.

TABLE 2

| | FIRST STEP | | | SECOND STEP | |
|---|---|---|---|---|---|
| | ENERGY (Ws) | PRESSURIZING FORCE (bar) | FIRST COMPRESSION RATIO (%) | SECOND COMPRESSION RATIO (%) | REMARKS |
| EXPERIMENTAL EXAMPLE 2(1) | 30 | 1 | 97 | 45 | COMPARATIVE EXAMPLE |
| EXPERIMENTAL EXAMPLE 2(2) | 30 | 1 | 97 | 52 | COMPARATIVE EXAMPLE |
| EXPERIMENTAL EXAMPLE 2(3) | 30 | 1 | 97 | 60 | COMPARATIVE EXAMPLE |
| EXPERIMENTAL EXAMPLE 2(4) | 30 | 1 | 97 | 70 | COMPARATIVE EXAMPLE |
| EXPERIMENTAL EXAMPLE 2(5) | 30 | 1 | 97 | 80 | COMPARATIVE EXAMPLE |
| EXPERIMENTAL EXAMPLE 2(6) | 30 | 1 | 97 | 90 | COMPARATIVE EXAMPLE |

TABLE 3

| | FIRST STEP | | | SECOND STEP | |
|---|---|---|---|---|---|
| | ENERGY (Ws) | PRESSURIZING FORCE (bar) | FIRST COMPRESSION RATIO (%) | SECOND COMPRESSION RATIO (%) | REMARKS |
| EXPERIMENTAL EXAMPLE 3(1) | 40 | 1 | 95 | 45 | COMPARATIVE EXAMPLE |
| EXPERIMENTAL EXAMPLE 3(2) | 40 | 1 | 95 | 52 | EXAMPLE |
| EXPERIMENTAL EXAMPLE 3(3) | 40 | 1 | 95 | 60 | EXAMPLE |
| EXPERIMENTAL EXAMPLE 3(4) | 40 | 1 | 95 | 70 | EXAMPLE |
| EXPERIMENTAL EXAMPLE 3(5) | 40 | 1 | 95 | 80 | EXAMPLE |
| EXPERIMENTAL EXAMPLE 3(6) | 40 | 1 | 95 | 90 | COMPARATIVE EXAMPLE |

Experimental Examples 3(2) to 3(6)

With respect to experimental examples 3(2) to 3(6), the terminal-attached electric wire was fabricated in the same way as in experimental example 3(1) with the exception that the second compression ratio in the second step had the values shown in Table 3.

Experimental Example 4(1)

With respect to experimental example 4(1), a terminal fitting was fabricated in the same way as in experimental example 1(1) with the exception that in the first step, the energy applied to the core wire was 50 Ws, and the first compression ratio was 90%. Table 4 shows the manufacturing conditions for the terminal-attached electric wire according to experimental example 4(1).

Figure 15:
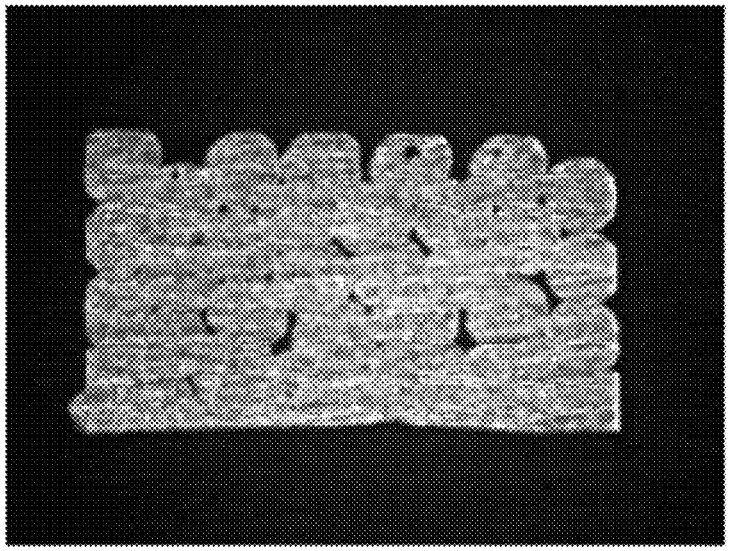
FIG. 15 is a photograph of a cross section of the core wire according to experimental example 4(1) after execution of the first step and before execution of the second step.

FIG. 15 shows an enlarged photograph of a cross section of the core wire after execution of the first step and prior to execution of the second step. In experimental example 4(1), it can be visually confirmed that while the roundness of the strand wires was slightly left intact, most of the strand wires had been bonded to each other and become integrated.

TABLE 4

| | FIRST STEP | | | SECOND STEP | |
|---|---|---|---|---|---|
| | ENERGY (Ws) | PRESSURIZING FORCE (bar) | FIRST COMPRESSION RATIO (%) | SECOND COMPRESSION RATIO (%) | REMARKS |
| EXPERIMENTAL EXAMPLE 4(1) | 50 | 1 | 90 | 45 | COMPARATIVE EXAMPLE |
| EXPERIMENTAL EXAMPLE 4(2) | 50 | 1 | 90 | 52 | EXAMPLE |
| EXPERIMENTAL EXAMPLE 4(3) | 50 | 1 | 90 | 60 | EXAMPLE |
| EXPERIMENTAL EXAMPLE 4(4) | 50 | 1 | 90 | 70 | EXAMPLE |
| EXPERIMENTAL EXAMPLE 4(5) | 50 | 1 | 90 | 80 | EXAMPLE |

Experimental Examples 4(2) to 4(5)

With respect to experimental examples 4(2) to 4(5), the terminal-attached electric wire was fabricated in the same way as in experimental example 4(1) with the exception that the second compression ratio in the second step had the values shown in Table 4.

Experimental Example 5(1)

With respect to experimental example 5(1), a terminal fitting was fabricated in the same way as in experimental example 1(1) with the exception that in the first step, the energy applied to the core wire was 60 Ws, and the first compression ratio was 85%. Table 5 shows the manufacturing conditions for the terminal-attached electric wire according to experimental example 5(1).

Figure 17:
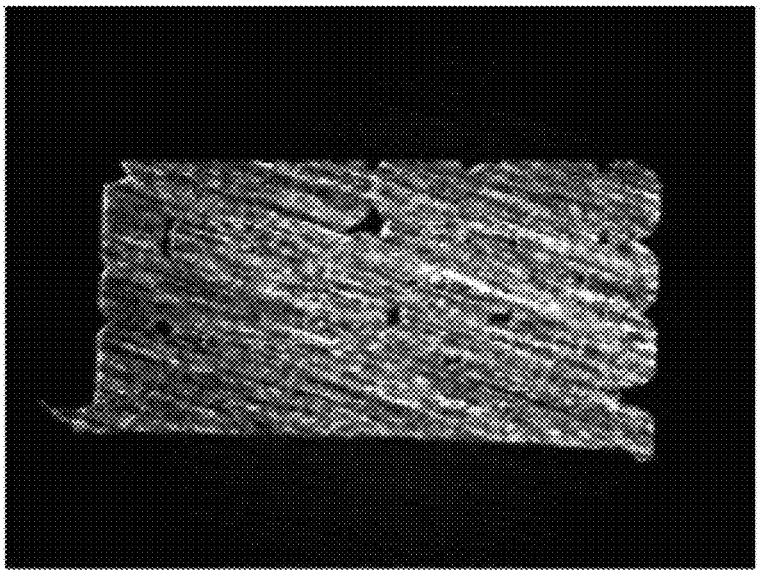
FIG. 17 is a photograph of a cross section of the core wire according to experimental example 5(1) after execution of the first step and before execution of the second step.

FIG. 17 shows an enlarged photograph of a cross section of the core wire after execution of the first step and prior to execution of the second step. In experimental example 5(1), it can be visually confirmed that the strand wires had been bonded to each other and become integrated.

TABLE 5

| | FIRST STEP | | | SECOND STEP | |
|---|---|---|---|---|---|
| | ENERGY (Ws) | PRESSURIZING FORCE (bar) | FIRST COMPRESSION RATIO (%) | SECOND COMPRESSION RATIO (%) | REMARKS |
| EXPERIMENTAL EXAMPLE 5(1) | 60 | 1 | 85 | 45 | COMPARATIVE EXAMPLE |
| EXPERIMENTAL EXAMPLE 5(2) | 60 | 1 | 85 | 52 | EXAMPLE |
| EXPERIMENTAL EXAMPLE 5(3) | 60 | 1 | 85 | 60 | EXAMPLE |
| EXPERIMENTAL EXAMPLE 5(4) | 60 | 1 | 85 | 70 | EXAMPLE |
| EXPERIMENTAL EXAMPLE 5(5) | 60 | 1 | 85 | 80 | EXAMPLE |

Experimental Examples 5(2) to 5(5)

With respect to experimental examples 5(2) to 5(5), the terminal-attached electric wire was fabricated in the same way as in experimental example 5(1) with the exception that the second compression ratio in the second step had the values shown in Table 5.

Experimental Example 6(1)

With respect to experimental example 6(1), a terminal fitting was fabricated in the same way as in experimental example 1(1) with the exception that in the first step, the energy applied to the core wire was 90 Ws, and the first compression ratio was 83%. Table 6 shows the manufacturing conditions for the terminal-attached electric wire according to experimental example 6(1).

TABLE 6

| | FIRST STEP | | | SECOND STEP | |
|---|---|---|---|---|---|
| | ENERGY (Ws) | PRESSURIZING FORCE (bar) | FIRST COMPRESSION RATIO (%) | SECOND COMPRESSION RATIO (%) | REMARKS |
| EXPERIMENTAL EXAMPLE 6(1) | 90 | 1 | 83 | 45 | COMPARATIVE EXAMPLE |
| EXPERIMENTAL EXAMPLE 6(2) | 90 | 1 | 83 | 52 | COMPARATIVE EXAMPLE |

TABLE 6-continued

| | FIRST STEP | | | SECOND STEP | |
|---|---|---|---|---|---|
| | ENERGY (Ws) | PRESSURIZING FORCE (bar) | FIRST COMPRESSION RATIO (%) | SECOND COMPRESSION RATIO (%) | REMARKS |
| EXPERIMENTAL EXAMPLE 6(3) | 90 | 1 | 83 | 60 | COMPARATIVE EXAMPLE |
| EXPERIMENTAL EXAMPLE 6(4) | 90 | 1 | 83 | 70 | COMPARATIVE EXAMPLE |
| EXPERIMENTAL EXAMPLE 6(5) | 90 | 1 | 83 | 80 | COMPARATIVE EXAMPLE |

Experimental Examples 6(2) to 6(5)

With respect to experimental examples 6(2) to 6(5), the terminal-attached electric wire was fabricated in the same way as in experimental example 6(1) with the exception that the second compression ratio in the second step had the values shown in Table 6.

Experimental Example 7(1)

With respect to experimental example 7(1), a terminal fitting was fabricated in the same way as in experimental example 1(1) with the exception that in the first step, the energy applied to the core wire was 95 Ws, and the first compression ratio was 80%. Table 7 shows the manufacturing conditions for the terminal-attached electric wire according to experimental example 7(1).

Figure 20:
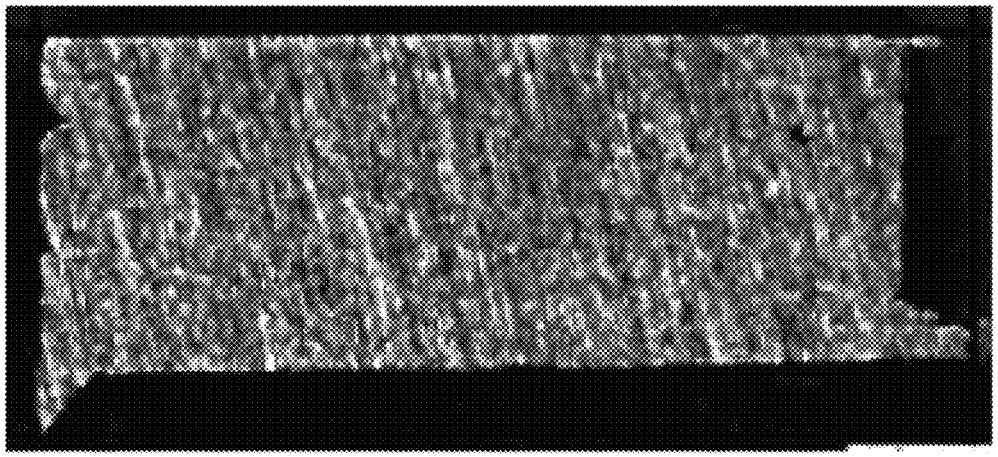
FIG. 20 is a photograph of a cross section of the core wire according to experimental example 7(1) after execution of the first step and before execution of the second step.

FIG. 20 is an enlarged photograph of a cross section of the core wire after execution of the first step and prior to execution of the second step. In experimental example 7(1), it can be visually confirmed that the strand wires had been bonded to each other and become integrated.

(Measurement of Contact Resistance Between Strand Wires and Terminal)

From the core wire 13 of the terminal-attached electric wires according to experimental examples 1(1) to 7(4) fabricated as described above, the strand wires 15 disposed in the vicinity of a position P on the inner side in the radial direction of the core wire 13, as illustrated in FIG. 6, were extended, and the electrical resistance between the extended strand wires 15 and the female terminal 12 was measured. For the contact resistance measurement, a general-purpose resistance measuring device was used, under the measurement conditions of a four terminal method. For each experimental example, the contact resistance was measured with respect to 10 samples, and an average value was considered the contact resistance value for the experimental example.

With respect to the experimental examples measured as described above, graphs illustrating the relationship between contact resistance and the second compression ratio are shown in the figures as follows. In the graphs of the figures, the horizontal axis shows the second compression ratio, and the vertical axis shows the contact resistance. In the graphs, variation in the measured values for the samples of the respective experimental examples is indicated by error bars extending in the top-bottom direction.

Figure 9:
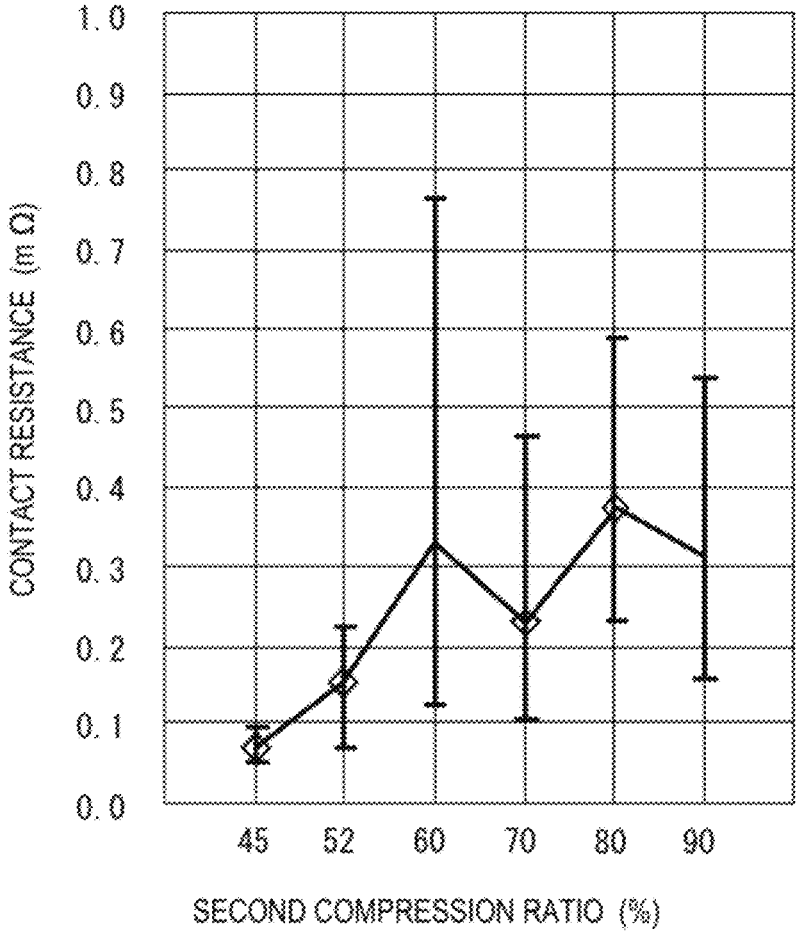
FIG. 9 is a graph illustrating a relationship between contact resistance and the second compression ratio according to experimental examples 1(1) to 1(6)

FIG. 9: Experimental examples 1(1) to 1(6)
FIG. 11: Experimental examples 2(1) to 2(6)
FIG. 12: Experimental examples 3(1) to 3(6)
FIG. 14: Experimental examples 4(1) to 4(5)

TABLE 7

| | FIRST STEP | | | SECOND STEP | |
|---|---|---|---|---|---|
| | ENERGY (Ws) | PRESSURIZING FORCE (bar) | FIRST COMPRESSION RATIO (%) | SECOND COMPRESSION RATIO (%) | REMARKS |
| EXPERIMENTAL EXAMPLE 7(1) | 95 | 1 | 80 | 45 | COMPARATIVE EXAMPLE |
| EXPERIMENTAL EXAMPLE 7(2) | 95 | 1 | 80 | 52 | COMPARATIVE EXAMPLE |
| EXPERIMENTAL EXAMPLE 7(3) | 95 | 1 | 80 | 60 | COMPARATIVE EXAMPLE |
| EXPERIMENTAL EXAMPLE 7(4) | 95 | 1 | 80 | 70 | COMPARATIVE EXAMPLE |

Experimental Examples 7(2) to 7(4)

With respect to experimental examples 7(2) to 7(4), the terminal-attached electric wire was fabricated in the same way as in experimental example 7(1) with the exception that the second compression ratio in the second step had the values shown in Table 7.

Figure 16:
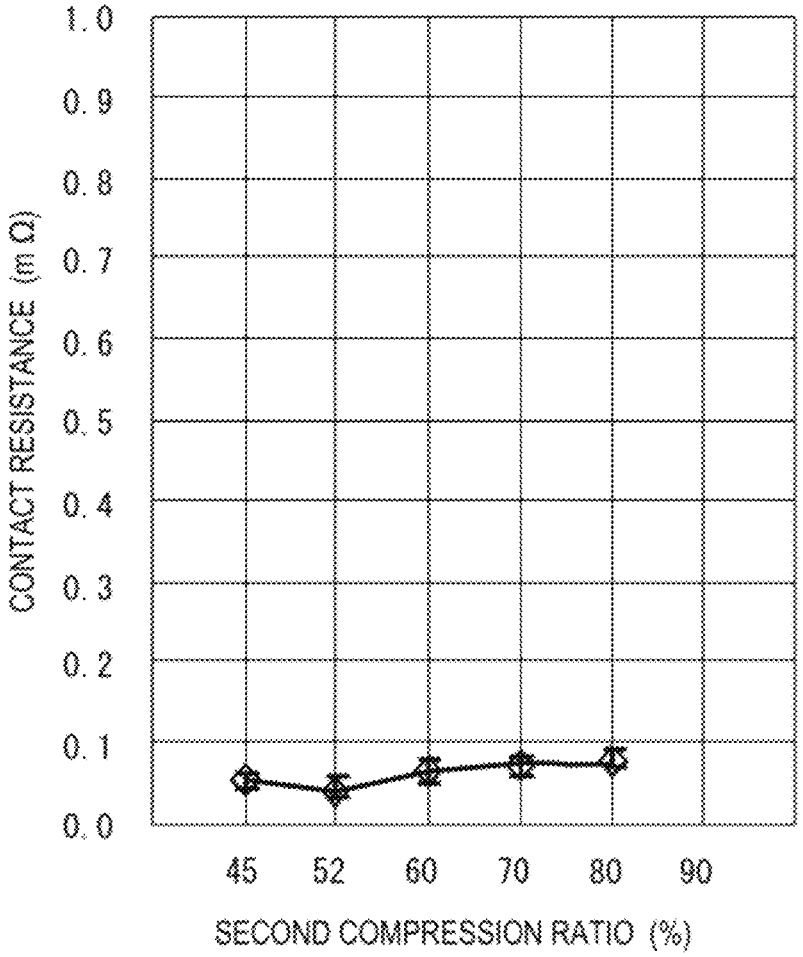
FIG. 16 is a graph illustrating a relationship between contact resistance and the second compression ratio according to experimental examples 5(1) to 5(5)

FIG. 16: Experimental examples 5(1) to 5(5)
FIG. 18: Experimental examples 6(1) to 6(5)
FIG. 19: Experimental examples 7(1) to 7(4)

Results and Analysis

Experimental Examples 1(1) to 1(6)

As indicated in Table 1, experimental examples 1(1) to 1(6) are comparative examples.

As illustrated in FIG. 9, in experimental example 1(1), in which the second compression ratio was 45%, the contact resistance exhibited a relatively low value of not more than 0.1 mΩ. However, in experimental example 1(1), the second compression ratio was 45%, and the core wire was relatively highly compressed. Some of the plurality of strand wires constituting the core wire may be cut, and the cut core wire may fall off from the wire barrels. This may cause a short-circuit and is therefore not preferable.

In experimental examples 1(2) to 1(6), the contact resistance was more than 0.1 mΩ. This makes it impossible to sufficiently decrease the electrical resistance between the core wire and the terminal, and is therefore not preferable.

In addition, in experimental examples 1(2) to 1(6), it has been found that, with respect to the contact resistance of each sample in each of the experimental examples, variation was relatively large. This is believed to be because the first compression ratio in the first step was 99% and the compression was relatively low, resulting in the absence of sufficient electrical connection between the strand wires. Accordingly, experimental examples 1(2) to 1(6) have relatively low electrical connection reliability, and are therefore not preferable.

As illustrated in FIG. 10, in experimental examples 1(1) to 1(6), the strand wires were not sufficiently electrically connected in the state after execution of the first step and prior to execution of the second step. Accordingly, it is necessary to lower the second compression ratio in the second step so as to have high compression. However, excessively high compression may lead to the cutting of the strand wires, as in experimental example 1(1).

Experimental Examples 2(1) to 2(6)

As indicated in Table 2, experimental examples 2(1) to 2(6) are comparative examples.

Figure 11:
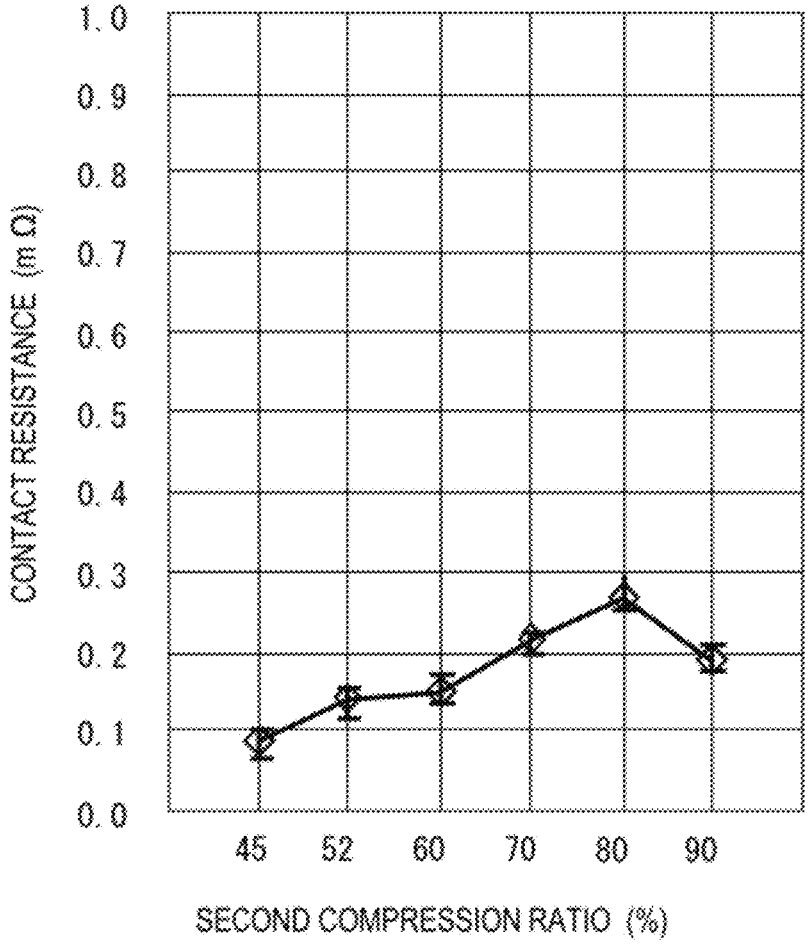
FIG. 11 is a graph illustrating a relationship between contact resistance and the second compression ratio according to experimental examples 2(1) to 2(6)

As illustrated in FIG. 11, in experimental example 2(1), in which the second compression ratio was 45%, the contact resistance exhibited a relatively low value of not more than 0.1 mΩ. However, in experimental example 2(1), the second compression ratio was 45%, and the core wire was relatively highly compressed. Some of the plurality of strand wires constituting the core wire may be cut, and the cut core wire may fall off from the wire barrels. This may cause a short-circuit and is therefore not preferable.

In experimental examples 2(2) to 2(6), the contact resistance was more than 0.1 mΩ. This makes it impossible to sufficiently decrease the electrical resistance between the core wire and the terminal, and is therefore not preferable.

Experimental Examples 3(1) to 3(6)

As indicated in Table 3, experimental examples 3(2) to 3(6) are examples, and experimental example 3(1) is a comparative example.

Figure 12:
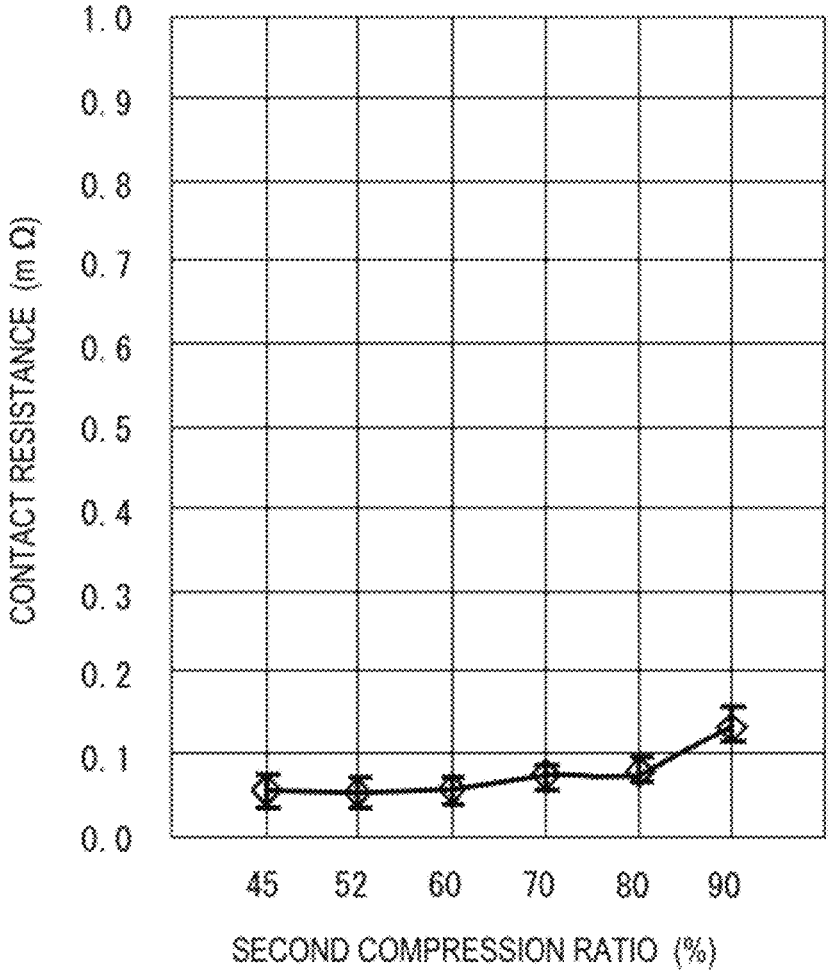
FIG. 12 is a graph illustrating a relationship between contact resistance and the second compression ratio according to experimental examples 3(1) to 3(6)

As illustrated in FIG. 12, in experimental example 3(1), in which the second compression ratio was 45%, the contact resistance exhibited a relatively low value of not more than 0.1 mΩ. However, in experimental example 3(1), the second compression ratio was 45%, and the core wire was relatively highly compressed. Some of the plurality of strand wires constituting the core wire may be cut, and the cut core wire may fall off from the wire barrels. This may cause a short-circuit and is therefore not preferable.

In experimental examples 3(2) to 3(5), in which the second compression ratio was between 52% and 70% inclusive, the contact resistance was not more than 0.1 mΩ, which is preferable.

As illustrated in FIG. 13, in experimental examples 3(1) to 3(6), in the state after execution of the first step and prior to execution of the second step, the strand wires are in a state of being sufficiently electrically connected. The strand wires positioned on the inside with respect to the radial direction of the core wire, and the strand wires positioned on the outside with respect to the radial direction of the core wire are electrically connected. Further, the strand wires positioned on the outside with respect to the radial direction of the core wire and the wire barrels are electrically connected. Thus, the contact resistance between the core wire and the female terminal can be decreased.

Experimental Examples 4(1) to 4(5)

As indicated in Table 4, experimental examples 4(2) to 4(5) are examples, and experimental example 4(1) is a comparative example.

Figure 14:
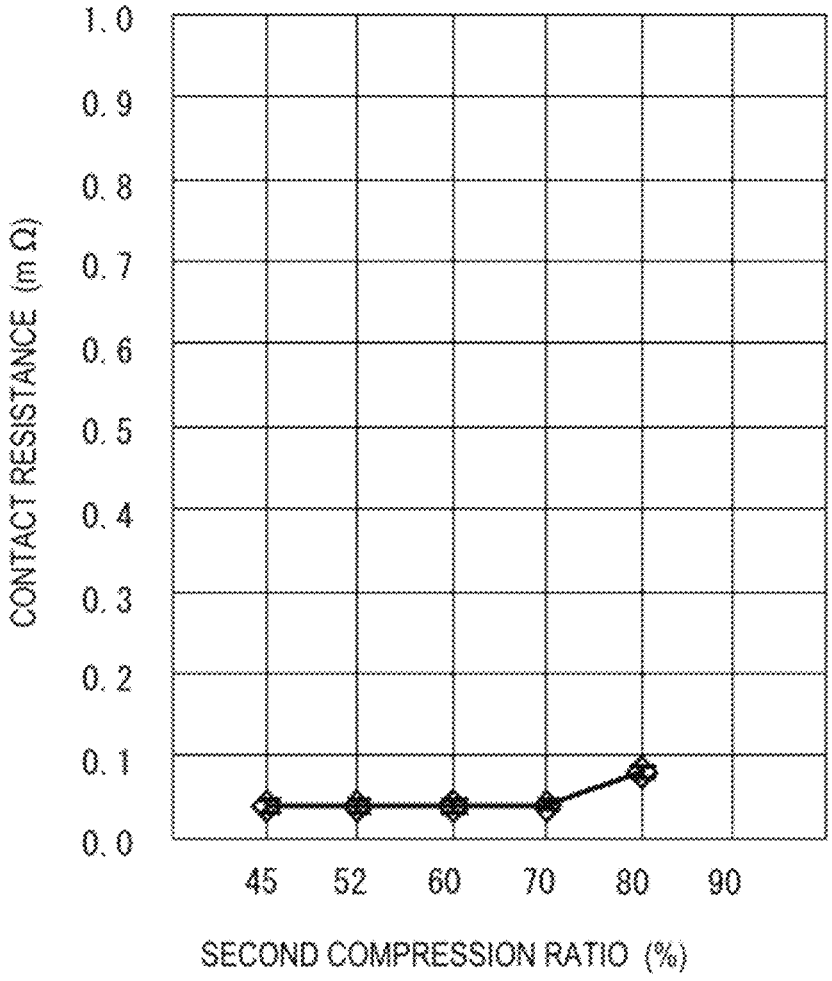
FIG. 14 is a graph illustrating a relationship between contact resistance and the second compression ratio according to experimental examples 4(1) to 4(5)

As illustrated in FIG. 14, in experimental example 4(1), in which the second compression ratio was 45%, the contact resistance exhibited a relatively low value of not more than 0.1 mΩ. However, in experimental example 4(1), the second compression ratio was 45%, and the core wire was relatively highly compressed. Some of the plurality of strand wires constituting the core wire may be cut, and the cut core wire may fall off from the wire barrels. This may cause a short-circuit and is therefore not preferable.

In experimental examples 4(2) to 4(5), in which the second compression ratio was between 52% and 70% inclusive, the contact resistance was not more than 0.1 mΩ, which is preferable.

As illustrated in FIG. 15, in experimental examples 4(1) to 4(5), in the state after execution of the first step and prior to execution of the second step, the strand wires are in a state of being sufficiently electrically connected. The strand wires positioned on the inside with respect to the radial direction of the core wire and the strand wires positioned on the outside with respect to the radial direction of the core wire are electrically connected. Further, the strand wires positioned on the outside with respect to the radial direction of the core wire and the wire barrels are electrically connected. Thus, the contact resistance between the core wire and the female terminal can be decreased.

Experimental Examples 5(1) to 5(5)

As indicated in Table 5, experimental examples 5(2) to 5(5) are examples, and experimental example 5(1) is a comparative example.

As illustrated in FIG. 16, in experimental example 5(1), in which the second compression ratio was 45%, the contact resistance exhibited a relatively low value of not more than 0.1 mΩ. However, in experimental example 5(1), the second compression ratio was 45%, and the core wire was relatively highly compressed. Some of the plurality of strand wires constituting the core wire may be cut, and the cut core wire may fall off from the wire barrels. This may cause a short-circuit and is therefore not preferable.

In experimental examples 5(2) to 5(5), in which the second compression ratio was between 52% and 70% inclusive, the contact resistance was not more than 0.1 mΩ, which is preferable.

As illustrated in FIG. 17, in experimental examples 5(1) to 5(5), in the state after execution of the first step and prior to execution of the second step, the strand wires are in a state of being mutually welded. Thus, the strand wires positioned on the inside with respect to the radial direction of the core wire, and the strand wires positioned on the outside with respect to the radial direction of the core wire are reliably electrically connected. Further, the strand wires positioned on the outside with respect to the radial direction of the core wire and the wire barrels are electrically connected. Thus, the contact resistance between the core wire and the female terminal can be reliably decreased.

Experimental Examples 6(1) to 6(5)

As indicated in Table 6, experimental examples 6(1) to 6(5) are comparative examples.

Figure 18:
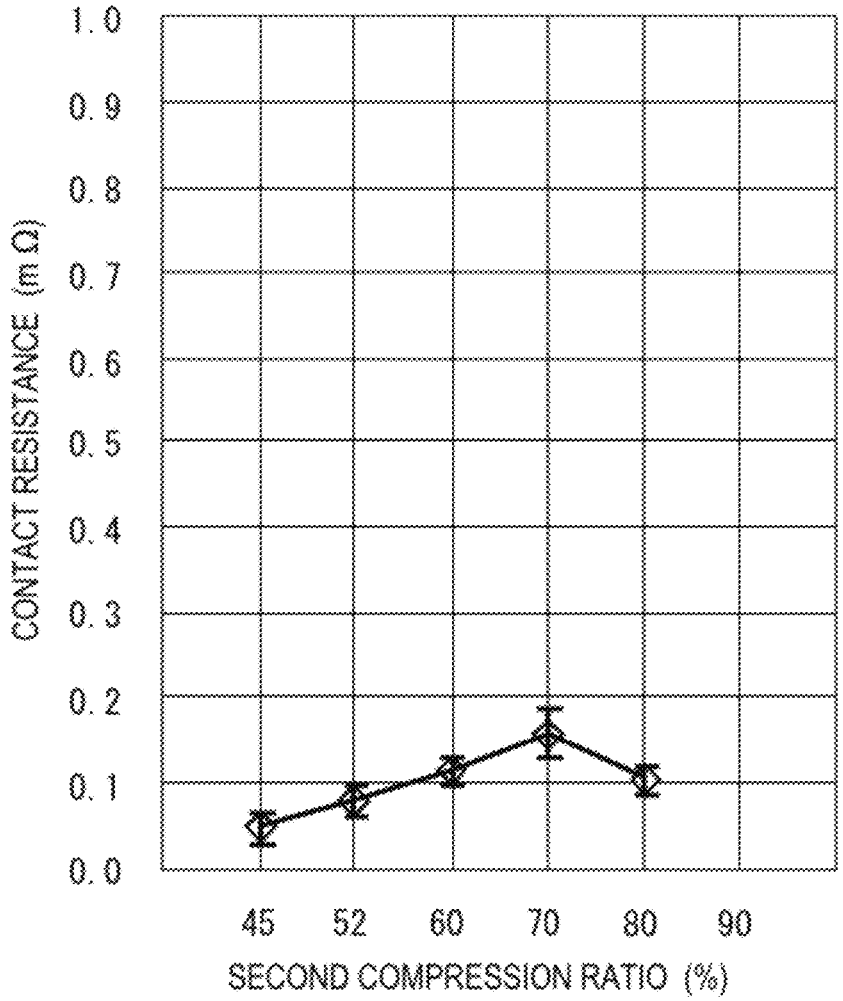
FIG. 18 is a graph illustrating a relationship between contact resistance and the second compression ratio according to experimental examples 6(1) to 6(5)

As illustrated in FIG. 18, in experimental example 6(1), in which the second compression ratio was 45%, the contact resistance exhibited a relatively low value of not more than 0.1 mΩ. However, in experimental example 6(1), the second compression ratio was 45%, and the core wire was relatively highly compressed. Some of the plurality of strand wires constituting the core wire may be cut, and the cut core wire may fall off from the wire barrels. This may cause a short-circuit and is therefore not preferable.

In experimental examples 6(3) to 6(5), the contact resistance exceeded 0.1 mΩ. This makes it impossible to sufficiently decrease the electrical resistance between the core wire and the terminal, and is therefore not preferable.

In experimental example 6(2), in which the second compression ratio was 52%, the contact resistance exhibited a relatively low value of not more than 0.1 mΩ. However, the experimental example 6(2) is not preferable for the following reasons. In experimental examples 6(1) to 6(5), the first compression ratio in the first step was 83%, which corresponds to relatively high compression. Accordingly, the difference between the second compression ratio in the second step and the first compression ratio is relatively small. Accordingly, when the wire barrels are crimped on the core wire in the second step, the amount of deformation of the core wire is relatively decreased. As a result, the core wire and the wire barrels cannot sufficiently contact each other, whereby, it is believed, the electrical connection reliability between the core wire and the wire barrels is decreased.

Experimental Examples 7(1) to 7(4)

As indicated in Table 7, experimental examples 7(1) to 7(4) are comparative examples.

Figure 19:
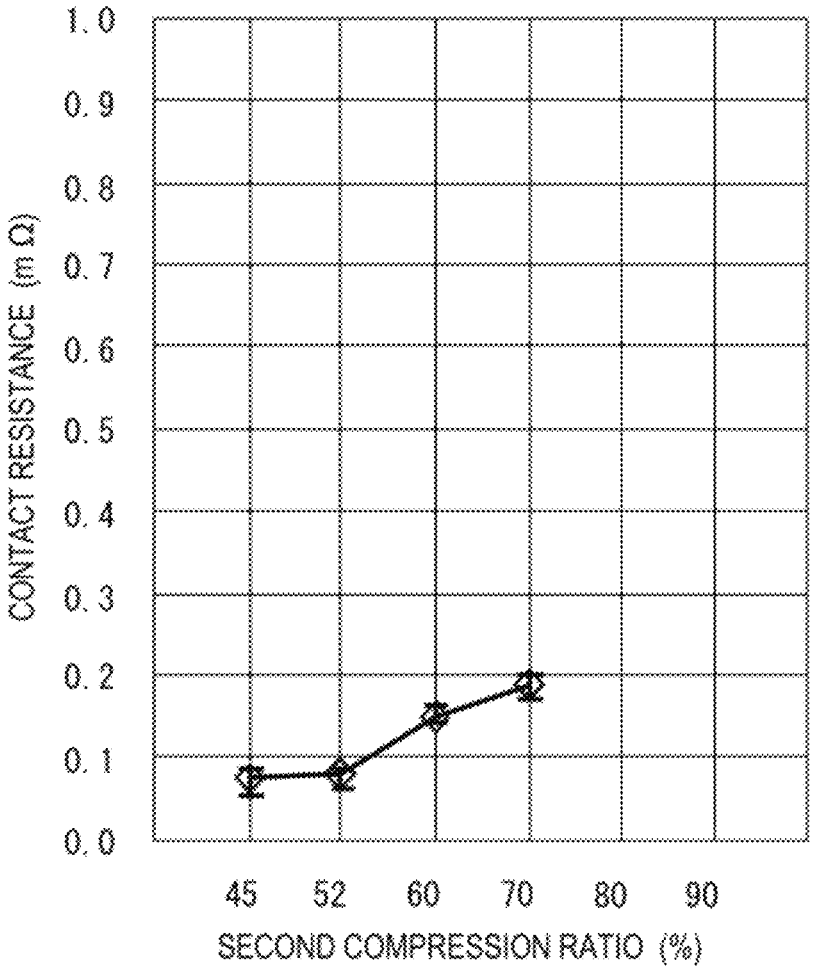
FIG. 19 is a graph illustrating a relationship between contact resistance and the second compression ratio according to experimental examples 7(1) to 7(4)

As illustrated in FIG. 19, in experimental example 7(1), in which the second compression ratio was 45%, the contact resistance exhibited a relatively low value of not more than 0.1 mΩ. However, in experimental example 7(1), the second compression ratio was 45%, and the core wire was relatively highly compressed. Some of the plurality of strand wires constituting the core wire may be cut, and the cut core wire may fall off from the wire barrels. This may cause a short-circuit and is therefore not preferable.

In experimental examples 7(3) to 7(4), the contact resistance exceeded 0.1 mΩ. This makes it impossible to sufficiently decrease the electrical resistance between the core wire and the terminal, and is therefore not preferable.

In experimental example 7(2), in which the second compression ratio was 52%, the contact resistance exhibited a relatively low value of not more than 0.1 mΩ. However, the experimental example 7(2) is not preferable for the following reasons. In experimental examples 7(1) to 7(4), in the first step, the first compression ratio is 80%, which is relatively high compression. Accordingly, the difference between the second compression ratio in the second step and the first compression ratio is even smaller than in experimental examples 1(1) to 6(5). Accordingly, when the wire barrels are crimped on the core wire in the second step, the amount of deformation of the core wire is relatively decreased. As a result, the core wire and the wire barrels cannot sufficiently contact each other, whereby, it is believed, the electrical connection reliability between the core wire and the wire barrels is decreased.

As illustrated in FIG. 20, in experimental examples 7(1) to 7(4), in the state after execution of the first step and prior to execution of the second step, the strand wires are welded and integrated.

Second Embodiment

Figure 21:
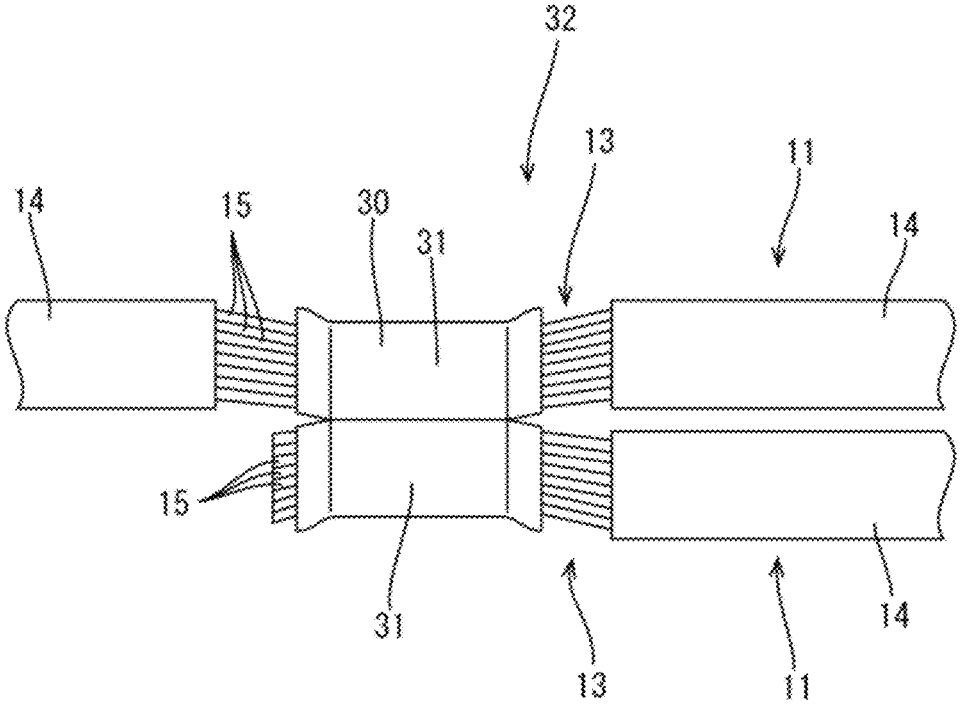
FIG. 21 is a plan view illustrating a terminal-attached electric wire according to a second embodiment.

A terminal-attached electric wire 32 according to a second embodiment of the present design will now be described with reference to FIG. 21. The terminal according to the present embodiment is a so-called splice terminal 30 (an example of the terminal) which does not include the connection portion 20. As illustrated in FIG. 21, the splice terminal 30 is configured such that, when two core wires 13 of the electric wires 11 are connected, the insulation coating 14 is peeled at the end of one of the electric wires 11 to expose the core wire 13. With respect to the other electric wire 11, the insulation coating 14 is peeled at the intermediate portion to expose the core wire 13. Each of the exposed two core wires 13 is crimped by one of a pair of wire barrels (an example of the crimp portion) 31.

In the present embodiment, in the state where the two core wires 13 of the electric wires 11 are crimped by the wire barrels 31, 20 or more strand wires 15 are crimped on the wire barrels 31. For example, when two electric wires 11 each having 19 strand wires 15 are crimped by the wire barrel 31 at once, 38 strand wires 15 are crimped on the wire barrels 31.

Third Embodiment

A terminal-attached electric wire 53 according to a third embodiment of the present design will be described with reference to FIG. 22. From the end of the electric wire 11, the insulation coating 14 is peeled only by a predetermined length, whereby the core wire 13 is exposed from the tip-end portion of the insulation coating 14. On the outer periphery of the core wire 13, the wire barrels 19 are crimped.

In the core wire 13, a primary compressed region 50 is formed in which the core wire 13 is compressed by, for example, pinching the core wire 13 with a pair of jigs and applying ultrasonic vibrations to the core wire 13.

Figure 22:
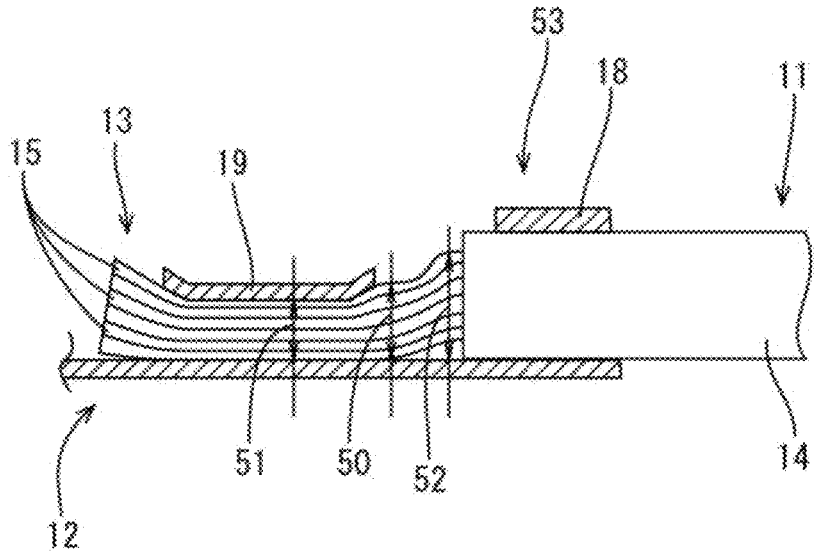
FIG. 22 is a partially enlarged cross sectional view of a terminal-attached electric wire according to a third embodiment.

As illustrated in FIG. 22, the wire barrels 19 are crimped in a region including the primary compressed region 50. Of the core wire 13, a region of the primary compressed region 50 that has been compressed by the application of ultrasonic vibrations which has further been compressed by the wire barrels 19 provides a secondary compressed region 51. All of the region in which the core wire 13 is compressed by the wire barrels 19 may be the primary compressed region. The region in which the core wire 13 is compressed by the wire barrels 19 may include a portion which is not the primary compressed region 50.

In the core wire, a non-compressed region 52 is formed in a position between the secondary compressed region 51 and the insulation coating 14, the position being different from the primary compressed region. In the non-compressed region 52, the wire barrels 19 are not crimped. To the non-compressed region 52, no ultrasonic vibrations are applied.

In the present embodiment, with respect to the direction from the insulation coating 14 of the electric wire 11 toward the female terminal 12, the insulation coating 14, the non-compressed region 52, the primary compressed region 50, and the secondary compressed region 51 are disposed side by side in that order.

The first compression ratio of the core wire 13 in the primary compressed region 50 is defined as follows.

(cross sectional area of the core wire in the primary compressed region/cross sectional area of the core wire in the non-compressed region)×100 (%)

In the present embodiment, the first compression ratio is between 85(%) and 95% inclusive.

The second compression ratio of the core wire 13 in the secondary compressed region 51 is defined as follows.

(cross sectional area of the core wire in the secondary compressed region/cross sectional area of the core wire in the non-compressed region)×100(%)

In the present embodiment, the second compression ratio is between 50(%) and 80% inclusive.

The configuration in other respects than the above is substantially the same as in the first embodiment. Accordingly, the same reference signs are assigned to the same members, and redundant descriptions are omitted.

In the present embodiment, with respect to the direction from the insulation coating 14 of the electric wire 11 to the female terminal 12, the insulation coating 14, the non-compressed region 52, the primary compressed region 50, and the secondary compressed region 51 are disposed side by side in that order. In this way, the core wire 13 is set such that, with respect to the direction from the insulation coating 14 to the female terminal 12, the compressed state of the core wire 13 becomes gradually higher in compression.

In the non-compressed region 52, ultrasonic vibrations are not applied to the core wire 13, and the wire barrels 19 are not crimped on the core wire 13. Accordingly, the core wire 13 in the non-compressed region 52 is in a state of not compressed at all.

In the primary compressed region 50, the first compression ratio is set between 85% and 95% inclusive. That is, the core wire 13 in the primary compressed region 50 is in a state of higher compression than in the non-compressed region 52.

In the secondary compressed region 51, the second compression ratio is set between 50% and 80% inclusive. That is, the core wire 13 in the secondary compressed region 51 is in a state of higher compression than in the primary compressed region 50.

Thus, the compressed state of the core wire 13 is set to become gradually higher from the insulation coating 14 toward the female terminal 12, so that the compressed state of the core wire 13 is not sharply changed. In this way, in the step of compressing the core wire 13, the damage to the core wire 13 can be decreased. As a result, severing of the strand wires 15 constituting the core wire 13 can be suppressed, and thus the electrical connection reliability of the female terminal 12 and the electric wire 11 can be increased.

Other Embodiments

The present invention is not limited to the embodiments explained in the above description and described with reference to the above drawings, and the technical scope of the present invention may include the following embodiments, for example.

The core wire 13 in the state in which the wire barrels 19 are crimped may include 2 to 36, or more than 37, strand wires 15.

The first embodiment is configured such that one electric wire 11 is connected to one female terminal 12. However, this is not a limitation, and a configuration may be adopted in which two or more electric wires 11 are connected to one female terminal 12.

The strand wires may not be welded to each other as long as the roughened region is formed on the surfaces of the strand wires by application of ultrasonic vibrations. A configuration may be adopted in which the strand wires that have been welded are loosened from each other and then crimped onto the wire barrels.

The pair of wire barrels 19 may be crimped on the core wire at places mutually displaced in the direction in which the electric wire 11 extends. Three or more diverging wire barrel pieces may be formed alternately from the right and left sides. Alternatively, a single wire barrel piece may be formed and crimped on the core wire 13. The shape of the wire barrels may be modified as needed.

While in the present embodiment, the terminal is the female terminal 12 having the tubular connection portion 20, this is not a limitation. The terminal may be a male terminal having a male tab, or a so-called LA terminal in which a through hole is formed in a metal sheet material. The terminal may have any shape as needed.

While in the present embodiment, the electric wire 11 is a coated electric wire in which the outer periphery of the core wire 13 is coated with the insulation coating 14, this is not a limitation. A sealed electric wire, a naked electric wire, or any other electric wire may be used as needed.

The splice terminal 30 in the second embodiment may be configured such that, while not illustrated, the core wires 13 are exposed at the intermediate portions of the two electric wires 11, and the exposed intermediate portions are crimped by one of the pair of wire barrels 31.

In the first embodiment, the core wire 13 is sandwiched by the pair of jigs 16, 16 in the top-bottom direction and subjected to ultrasonic vibrations. However, this is not a limitation. The core wire 13 may be sandwiched by the pair of jigs 16, 16 in the right-left direction, or may be configured so as to be sandwiched by a plurality of jigs 16 in desired directions as needed.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above.

Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

EXPLANATION OF SYMBOLS

10: Terminal-attached electric wire
11: Electric wire
12: Female terminal (terminal)
13, 113, 213: Core wire
15, 115, 215: Strand wire
16: Jig
17: Roughened region
19: Wire barrel (crimp portion)
30: Splice terminal (terminal)

The invention claimed is:

1. A method for manufacturing a terminal-attached electric wire including an electric wire including a core wire having a plurality of strand wires, and a terminal including a crimp portion crimped around the core wire, the method comprising:

a first step of applying ultrasonic vibrations to the core wire; and a second step of crimping the crimp portion in a region of the core wire in which the ultrasonic vibrations have been applied, wherein the first step includes applying ultrasonic vibrations to the core wire according to a first compression ratio that is between 85% and 95%, inclusive, so as to leave a compression margin for the crimping in the second step such that resistance between the electric wire and the terminal is stabilized until the strand wires of the terminal-attached electric wire are severed when the core wire of the terminal-attached electric wire is further compressed after the second step, and the second step includes crimping the crimp portion according to a second compression ratio that is between 50% and 80%, inclusive, wherein the first compression ratio is defined as the quotient of a cross sectional area of the core wire after the first step divided by a cross sectional area of the core before the first step, multiplied by 100%, and the second compression ratio is defined as the quotient of a cross sectional area of the core wire after the second step divided by a cross sectional area of the core wire before the first step, multiplied by 100%.

2. The method for manufacturing a terminal-attached electric wire according to claim 1, wherein the strand wires include aluminum or an aluminum alloy.

3. The method for manufacturing a terminal-attached electric wire according to claim 1, wherein:

the plurality of strand wires include 20 or more strand wires; and in a state in which the crimp portion is crimped on the core wire, the 20 or more strand wires are crimped on the crimp portion.

4. A terminal-attached electric wire comprising:

an electric wire including a core wire having a plurality of strand wires; and a terminal including a crimp portion crimped around the core wire, wherein:

the terminal-attached electric wire is manufactured by executing a first step of applying ultrasonic vibrations to the core wire, and a second step of crimping the crimp portion in a region of the core wire to which ultrasonic vibrations have been applied;

the first step includes applying ultrasonic vibrations to the core wire according to a first compression ratio that is between 85% and 95%, inclusive, while leaving a compression margin for the crimping by the second step such that resistance between the electric wire and the terminal is stabilized until the strand wires of the terminal-attached electric wire are severed when the core wire of the terminal-attached electric wire is compressed, and the second step includes crimping the crimp portion according to a second compression ratio that is between 50% and 80%, inclusive, wherein the first compression ratio is defined as the quotient of a cross sectional area of the core wire after the first step divided by a cross sectional area of the core before the first step, multiplied by 100%, and the second compression ratio is defined as the quotient of a cross sectional area of the core wire after the second step divided by a cross sectional area of the core wire before the first step, multiplied by 100%.

* * * * *